US007980887B2

(12) United States Patent
Urano et al.

(10) Patent No.: US 7,980,887 B2
(45) Date of Patent: Jul. 19, 2011

(54) CONNECTOR

(75) Inventors: Kazumi Urano, Makinohara (JP); Hiroaki Yamagishi, Fujieda (JP); Toshinori Sakurai, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/784,600

(22) Filed: May 21, 2010

(65) Prior Publication Data

US 2011/0008988 A1 Jan. 13, 2011

(30) Foreign Application Priority Data

Jul. 9, 2009 (JP) ..... P. 2009-162470

(51) Int. Cl.
*H01R 3/00* (2006.01)

(52) U.S. Cl. ..... 439/489; 439/352

(58) Field of Classification Search ..... 439/489, 439/352

See application file for complete search history.

(56) References Cited

U.S. PATENT DOCUMENTS 6,012,946 A * 1/2000 Fukase ..... 439/489
6,494,732 B2 * 12/2002 Kashiyama et al. ..... 439/352
6,514,099 B2 * 2/2003 Endo ..... 439/489
6,551,146 B2 * 4/2003 Nakamura ..... 439/752
6,568,954 B2 * 5/2003 Endo et al. ..... 439/489
6,579,118 B2 * 6/2003 Endo ..... 439/489
6,692,288 B2 * 2/2004 Nimura ..... 439/352
6,824,417 B1 * 11/2004 Nimura ..... 439/352
7,722,385 B2 * 5/2010 Nakamura ..... 439/489
2003/0045161 A1 * 3/2003 Endo et al. ..... 439/489
2003/0077936 A1 * 4/2003 Tsuji et al. ..... 439/489
2004/0023547 A1 2/2004 Oka

* cited by examiner

*Primary Examiner* — Gary F. Paumen
(74) *Attorney, Agent, or Firm* — Finnegan, Henderson, Farabow, Garrett & Dunner, LLP

(57) ABSTRACT

A connector includes a first housing, a second housing and a detection member. A lock band portion is elastically deformable and is provided on the first housing. A lock portion is provided on the second housing, and bends the lock band portion to allow the lock band portion to slide over the lock portion when the first and second housings are moved from a first condition to a second condition, the first condition where the first housing is not fitted to the second housing, and the second condition where the first housing is fitted to the second housing, and engages the lock band portion when the first and second housings has been moved to the second position. The detection member is disposed on an upper side of the lock band portion, and is displaced together with the lock band portion in accordance with a deforming movement of the lock band portion. A movement limitation portion is provided on the detection member, and abuts against an abutment limitation portion provided on the first housing while the first and second housings are moved from the first condition to the second condition, so that the detection member is prevented from movement in the attaching direction. When the lock portion engages the lock band portion in the second condition, an abutment of the movement limitation portion against the abutment limitation portion is canceled, so that the detection member is allowed to be moved in the attaching direction.

7 Claims, 18 Drawing Sheets

CONNECTOR

BACKGROUND

This invention relates to a connector capable of detecting a half-fitted condition.

Among conventional connectors capable of detecting a half-fitted condition of a pair of housings, there is known the type of connector including a pair of connector housings, and a fitting detection member attached to one of the connector housings (see, for example, Patent Literature 1).

In this conventional connector, a lock arm is provided at the one connector housing, and can be elastically deformed toward a bending space by the other connector housing. Elastic arms are provided at the detection member, and can be elastically deformed in accordance with the bending movement of the lock arm. Reception portions are provided respectively at the elastic arms, and when the elastic arms are elastically deformed, these reception portions are retainingly engaged respectively with retaining portions of the one connector housing, thereby preventing the detection member from being pushed into the bending space. When the pair of connector housings are properly fitted together, the elastic arms of the detection member are elastically restored into their initial condition in accordance with a restoring movement of the lock arm, and the retaining engagement of each retaining portion with the corresponding reception portion is canceled, so that the detection member can be pushed into the bending space.

Therefore, in the properly-fitted condition of the pair of the connector housings, the detection member can be pushed into the bending space, and therefore the worker can detect the fact that the pair of connector housings has been properly fitted together.

[Patent Literature 1] US2004/0023547A1

In the above conventional connector, however, the elastic arms of the detection member were elastically deformed in accordance with the bending movement of the lock arm, and therefore when the detection member was used a plurality of times, it was feared that the restoring ability of the elastic arms might be lowered, and there was a possibility that the durability of the detection member was lowered.

Furthermore, in accordance with the bending movement of the lock arm, the elastic arms of the detection member were moved backward in a direction opposite to the fitting direction, and also were opened or moved away from each other in a widthwise direction, and therefore it was necessary to secure spaces for allowing the backward movement of the detection member and the opening movement of the elastic arms, and as a result the size of the connector increased.

SUMMARY

It is therefore an object of this invention to provide a connector in which the durability of a detection member can be enhanced, and also an increased size of the connector can be prevented.

In order to achieve the above object, according to the present invention, there is provided a connector comprising:

a first housing:

a second housing that is fitted to the first housing: and a detection member that is attached to the first housing to detect a fitted condition of the first and second housings by a movement of the detection member in an attaching direction of the detection member to the first housing, wherein a lock band portion is elastically deformable and is provided on the first housing;

wherein a lock portion is provided on the second housing, and bends the lock band portion to allow the lock band portion to slide over the lock portion when the first and second housings are moved from a first condition to a second condition, and engages the lock band portion when the first and second housings has been moved to the second position, the first condition where the first housing is not fitted to the second housing and the second condition where the first housing is fitted to the second housing;

wherein the detection member is disposed on an upper side of the lock band portion, and is displaced together with the lock band portion in accordance with a deforming movement of the lock band portion;

wherein a movement limitation portion is provided on the detection member, and abuts against an abutment limitation portion provided on the first housing while the first and second housings are moved from the first condition to the second condition, so that the detection member is prevented from movement in the attaching direction; and wherein when the lock portion engages the lock band portion in the second condition, an abutment of the movement limitation portion against the abutment limitation portion is canceled, so that the detection member is allowed to be moved in the attaching direction.

Preferably, the detection member has a shaking limitation portion which abuts against a shaking abutment limitation portion provided on the first housing before the second condition to limit the movement of the detection member in a direction intersecting the attaching direction.

Preferably, the detection member has a provisional movement limitation portion which abuts against a provisional abutment limitation portion provided on the first housing before the second condition to limit the movement of the detection member in the attaching direction.

Here, it is preferable that, the second housing has a provisional lock cancellation portion which holds a state in which an abutment of the provisional abutment limitation portion and the provisional movement limitation portion is cancelled when the lock portion engages the lock band portion.

Preferably, the detection member has a cancellation movement limitation portion which abuts against a cancellation abutment limitation portion provided on the first housing before the second condition, so that the detection member is prevented from movement in a cancellation direction opposite to the attaching direction.

Preferably, the detection member has a holding lock portion which is retained by a detection lock portion provided on the first housing to maintain an attached condition of the detection member relative to the first housing when the detection member is moved in the attaching direction in the second condition.

By the above configuration, the detection member is disposed on the upper side of the lock band portion, and is displaced together with the lock band portion in accordance with the deforming movement of the lock band portion. When the lock band portion is disposed on the upper side of the lock portion, the movement limitation portion provided on the detection member abuts against the abutment limitation portion provided on the first housing, thereby preventing the detection member from movement in the attaching direction. When the lock band portion is engaged by the lock portion, the abutment of the movement limitation portion against the abutment limitation portion is canceled, thereby enabling the detection member to move in the attaching direction.

Therefore, the detection member will not be deformed by the bending of the lock band portion, and in accordance with the displacement of the detection member itself, the movement limitation portion is brought into and out of abutting engagement with the abutment limitation portion, and the limitation of the movement of the detection member and the cancellation of this movement limitation are effected, and the fitted condition of the pair of housings can be detected.

Therefore, the detection member, even when used a plurality of times, will not be deformed, and the durability of the detection member can be enhanced. And besides, since the detection member will not be deformed, it is not necessary to provide a space for allowing the deformation of the detection member, and the connector is prevented from increasing in size.

By the above configuration, the detection member has the shaking limitation portion which abuts against the shaking abutment limitation portion of the first housing before the fitting of the first and second housings, thereby limiting or preventing the movement of the detection member in the direction intersecting the attaching direction. Therefore, the detection member will not shake relative to the first housing before the fitting of the first and second housings, and the provisionally-attached condition of the detection member relative to the first housing can be stably maintained.

By the above configuration, the detection member has the provisional movement limitation portion which abuts against the provisional abutment limitation portion of the first housing before the fitting of the first and second housings, thereby preventing the detection member from movement in the attaching direction. Therefore, before the first and second housings are fitted together, the detection member will not be attached to the first housing, and the detection member can be positively held in a predetermined position before the detection.

By the above configuration, the second housing has the provisional lock cancellation portion which holds the provisional movement limitation portion and the provisional abutment limitation portion in their abutment-canceled condition when the lock band portion is engaged by the lock portion. Therefore, when the lock band portion is engaged by the lock portion, the detection member can be moved in the attaching direction, and the properly-fitted condition of the first and second housings can be positively detected by the detection member.

By the above configuration, the detection member has the cancellation movement limitation portion which abuts against the cancellation abutment limitation portion of the first housing before the fitting of the first and second housings, thereby preventing the detection member from movement in the attaching-cancellation direction. Therefore, before the first and second housings are fitted together, the detection member can be prevented from being disengaged from the first housing, and the detection member provisionally attached to the first housing can be conveyed together with the first housing.

By the above configuration, the detection member has the holding lock portion which is retained by the detection lock portion of the first housing to thereby maintain the attached condition of the detection member relative to the first housing when the detection member is moved in the attaching direction after the fitting of the first and second housings. Therefore, after the first and second housings are fitted together, the detection member can be positively held on the first housing.

BRIEF DESCRIPTION OF THE DRAWINGS

The above objects and advantages of the present invention will become more apparent by describing in detail preferred exemplary embodiments thereof with reference to the accompanying drawings, wherein:

FIG. 13A is a perspective view showing the detection member and the one housing of the connector of the second embodiment;

DETAILED DESCRIPTION OF EXEMPLARY EMBODIMENTS

Figure 1:
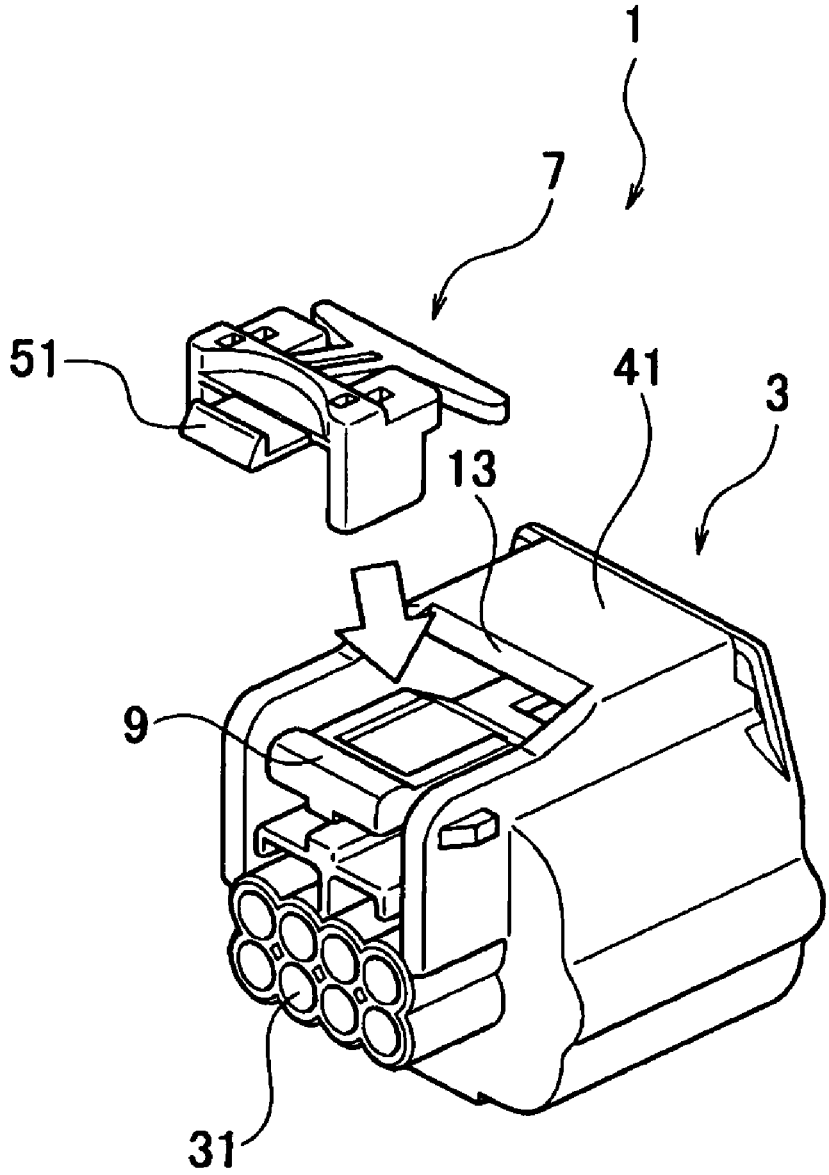
FIG. 1 is a perspective view showing one housing and a detection member of a connector according to a first embodiment of the present invention.
Figure 2:
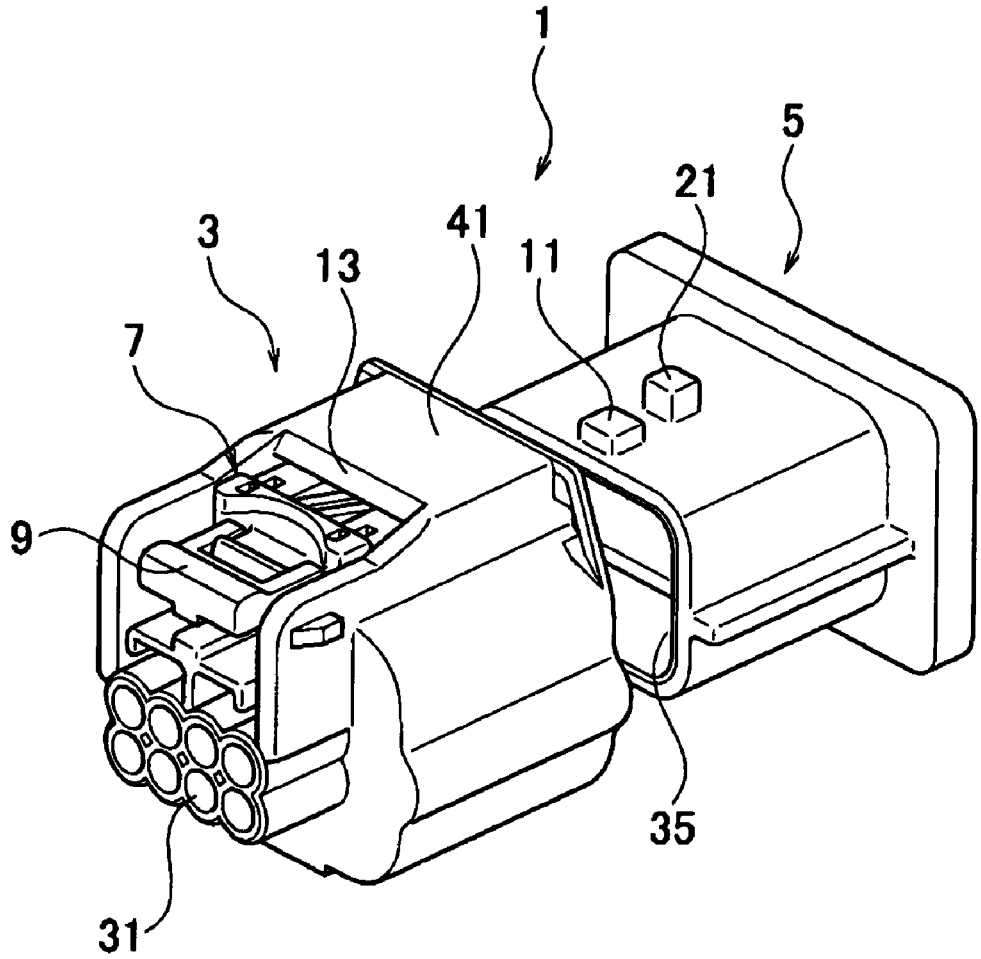
FIG. 2 is a perspective view of the connector of the first embodiment.
Figure 3A:
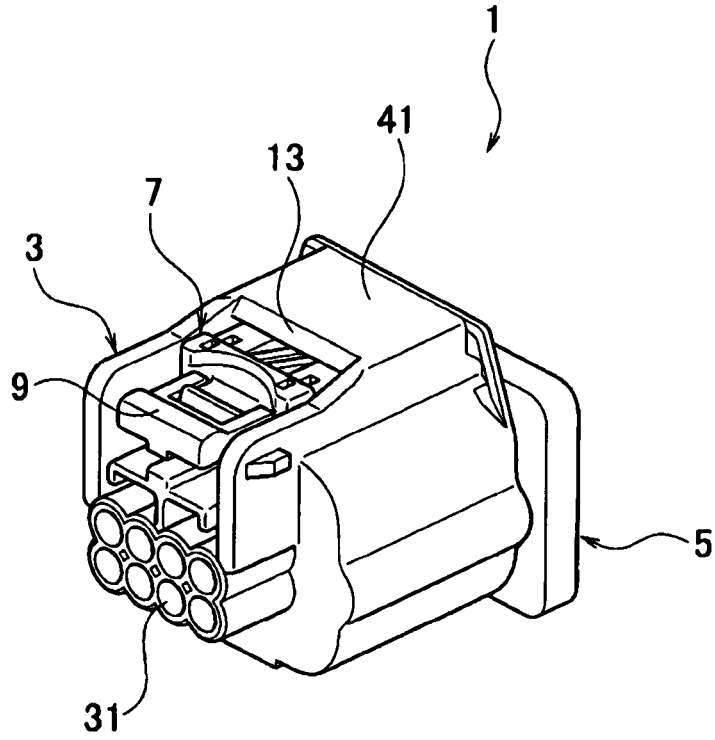
FIG. 3A is a perspective view of the connector of the first embodiment, showing a fitted condition of a pair of housings.
Figure 3B:
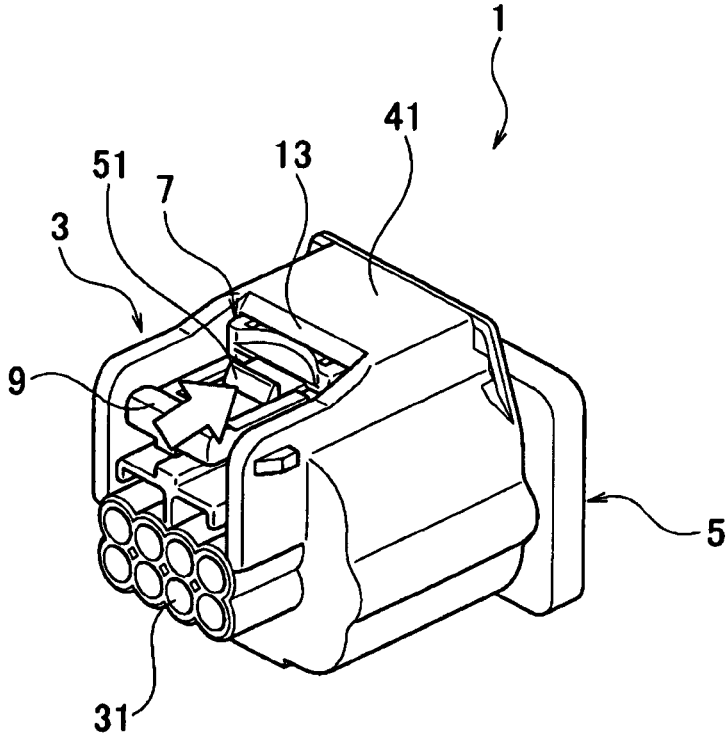
FIG. 3B is a perspective view showing a condition in which the detection member of FIG. 3A is attached to the one housing.
Figure 4A:
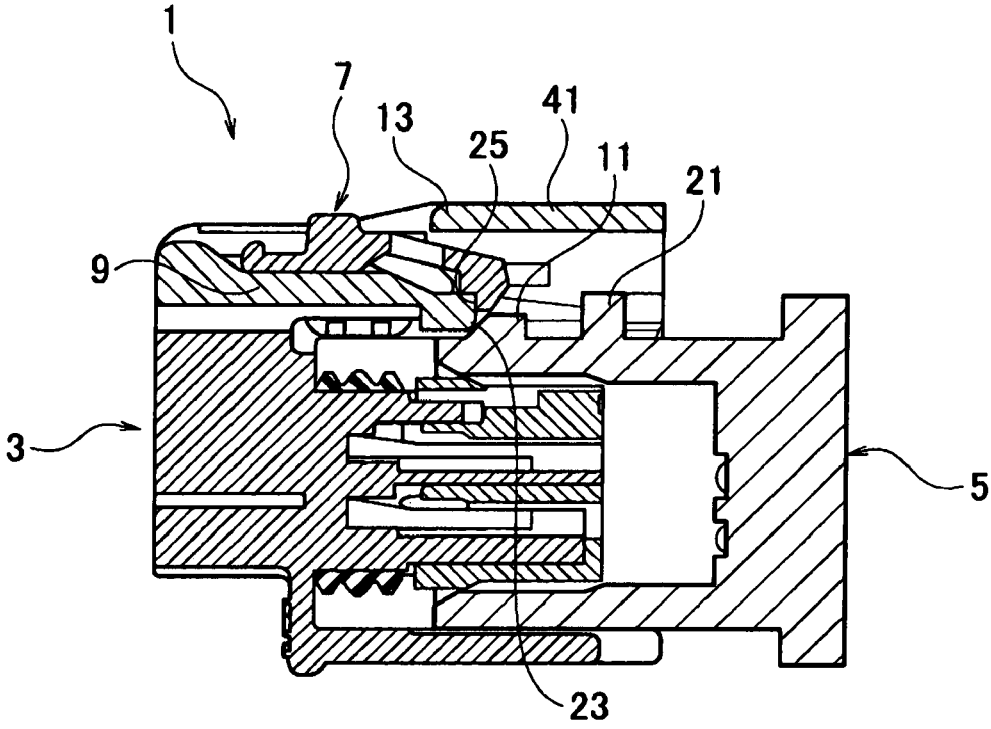
FIG. 4A is a cross-sectional view of the connector of the first embodiment, showing a condition before the pair of housings are fitted together.
Figure 4B:
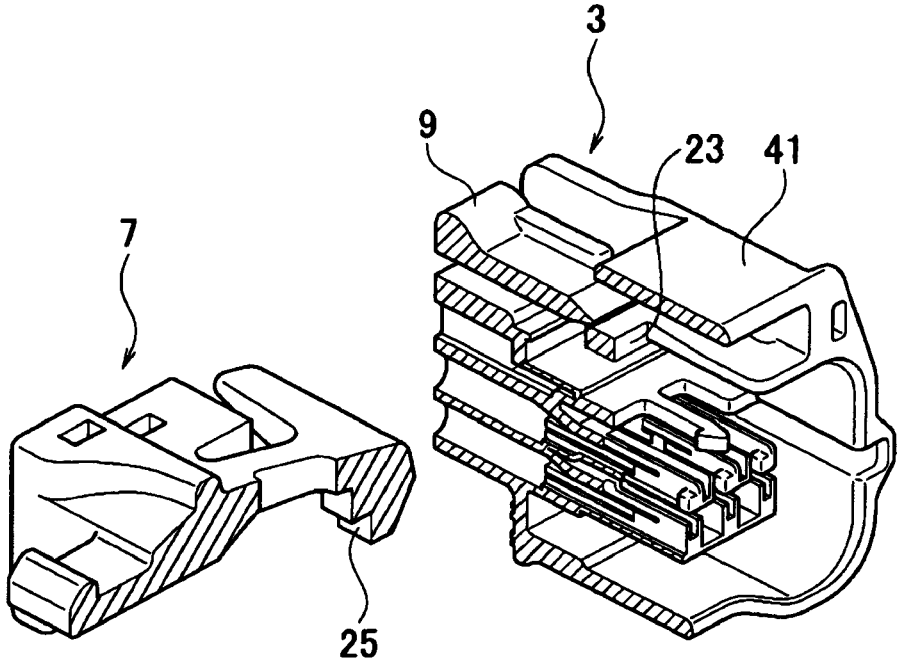
FIG. 4B is a partly cross-sectional view showing important portions of the connector.
Figure 5A:
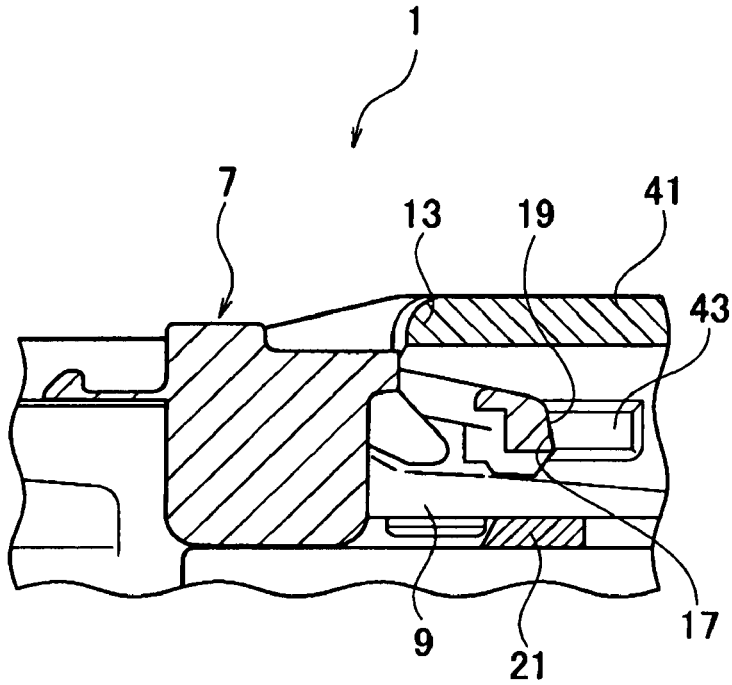
FIG. 5A is an enlarged cross-sectional view showing an important portion of FIG. 4A.
Figure 5B:
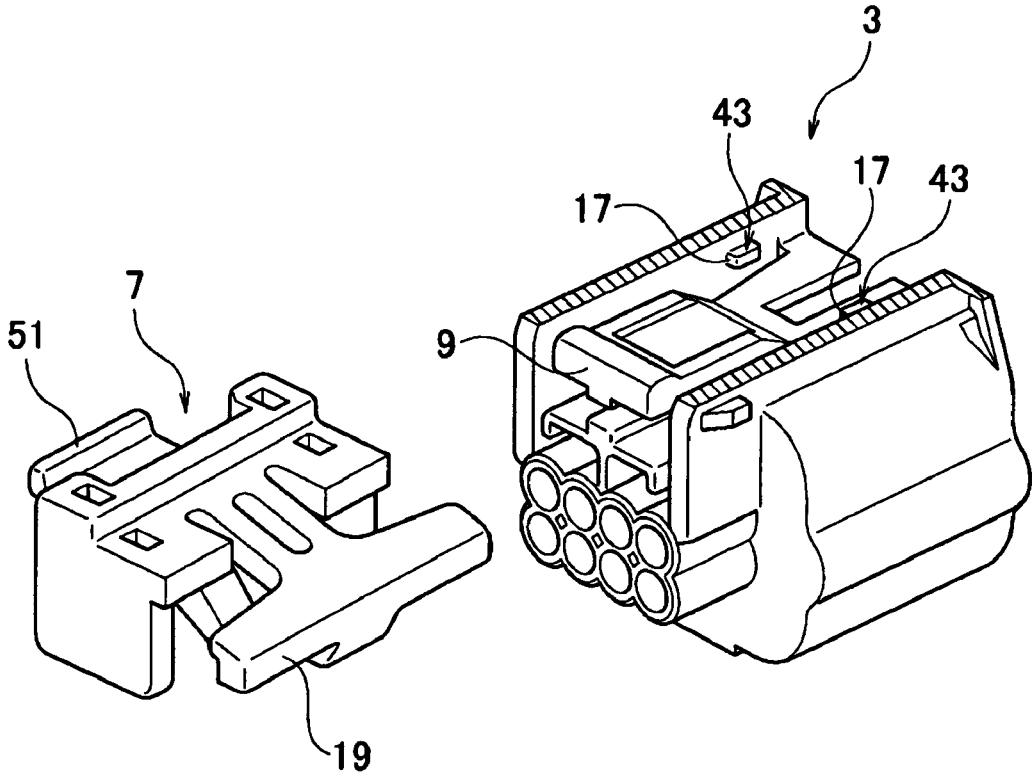
FIG. 5B is a perspective view of the connector of the first embodiment, showing a condition in which the detection member is detached, and a hood portion of the one housing is removed.
Figure 6A:
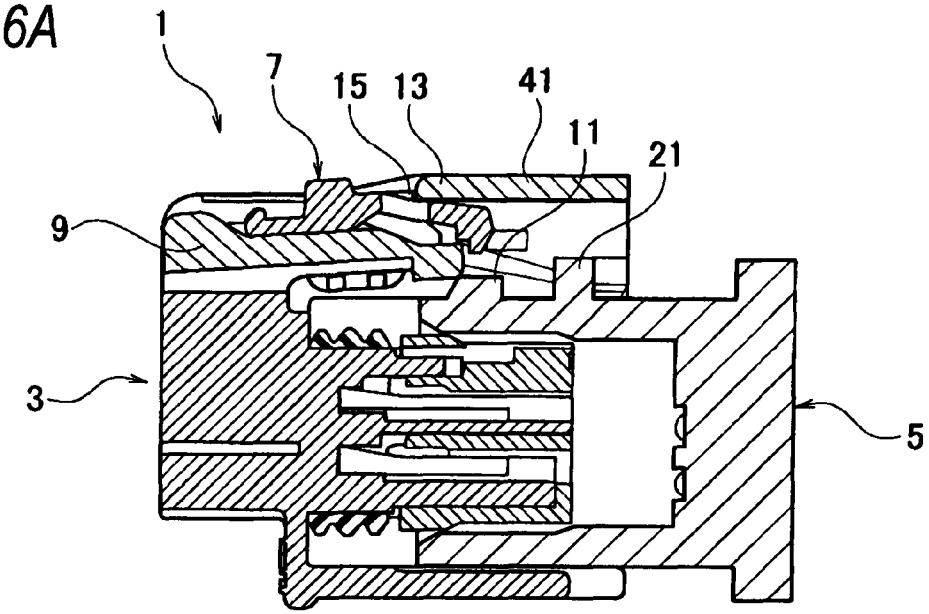
FIG. 6A is a cross-sectional view showing the connector of the first embodiment during the fitting of the pair of housings.
Figure 6B:
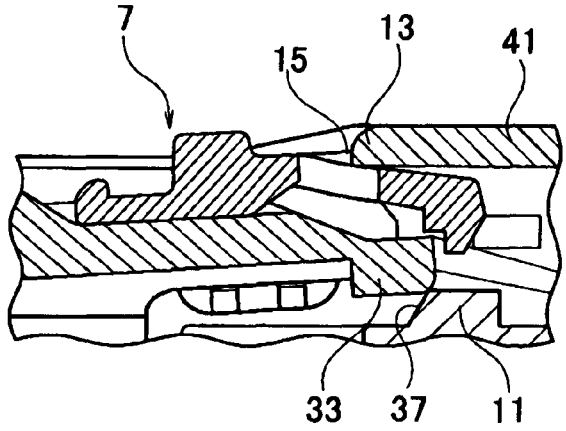
FIG. 6B is an enlarged cross-sectional view of an important portion.
Figure 6C:
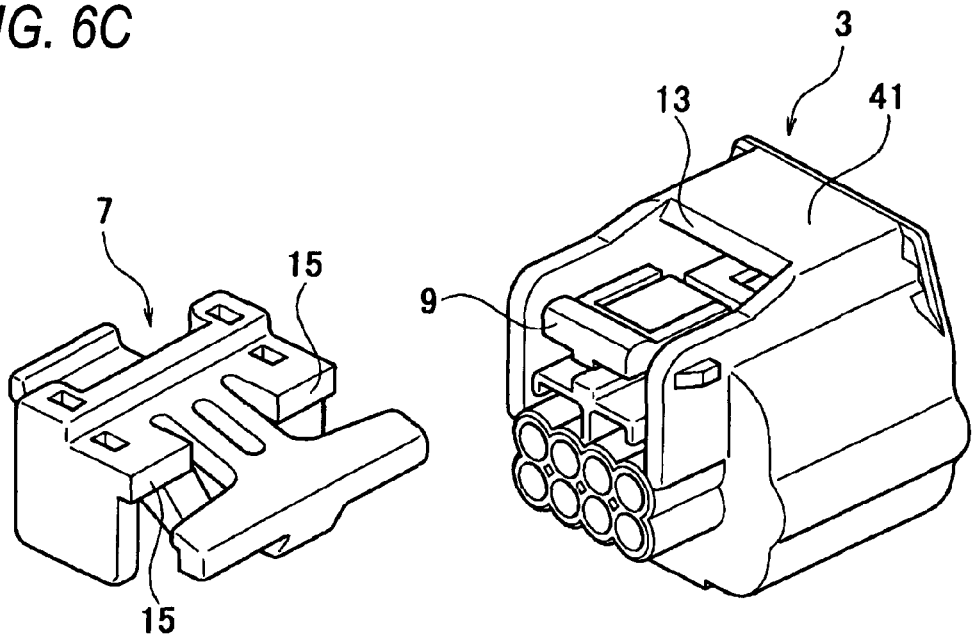
FIG. 6C is a perspective view showing the detection member and the one housing of the connector of the first embodiment.
Figure 7A:
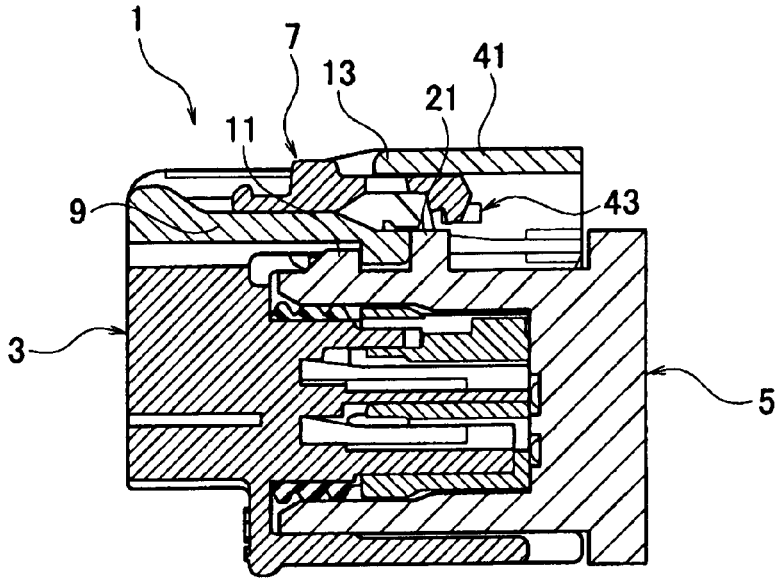
FIG. 7A is a cross-sectional view of the connector of the first embodiment, showing a condition in which the pair of housings are fitted together.
Figure 7B:
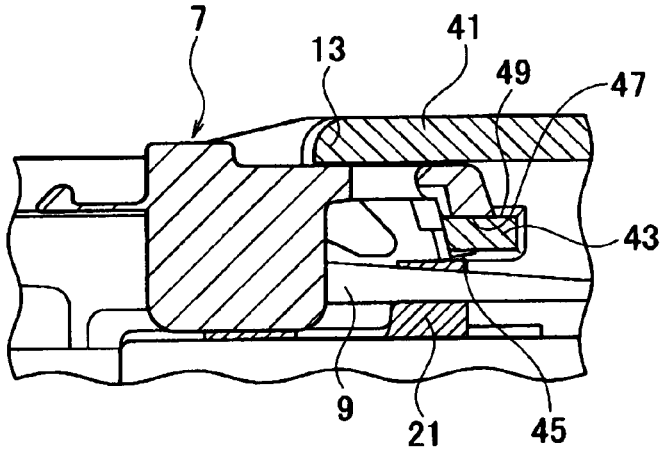
FIG. 7B is an enlarged cross-sectional view of an important portion of FIG. 7A.
Figure 7C:
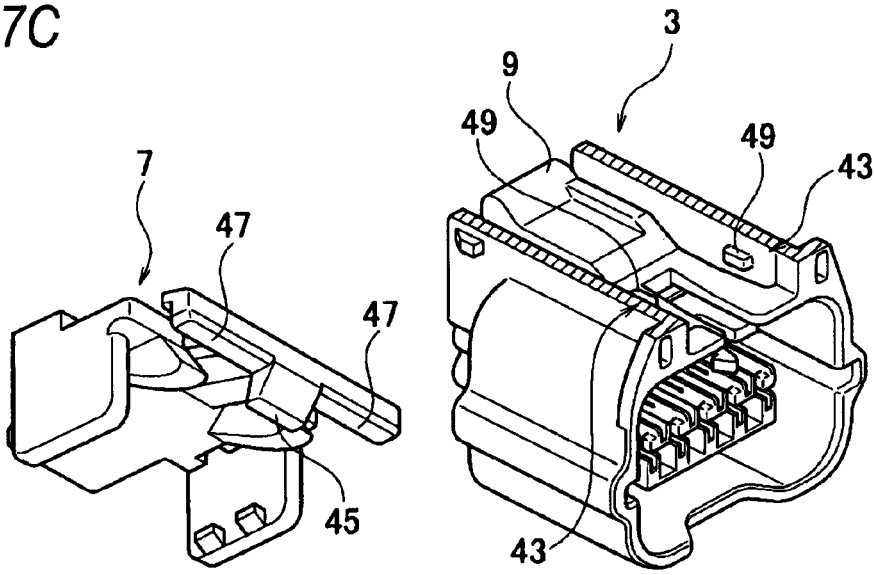
FIG. 7C is a perspective view of the connector of the first embodiment, showing a condition in which the detection member is detached, and the hood portion of the one housing is removed.
Figure 8A:
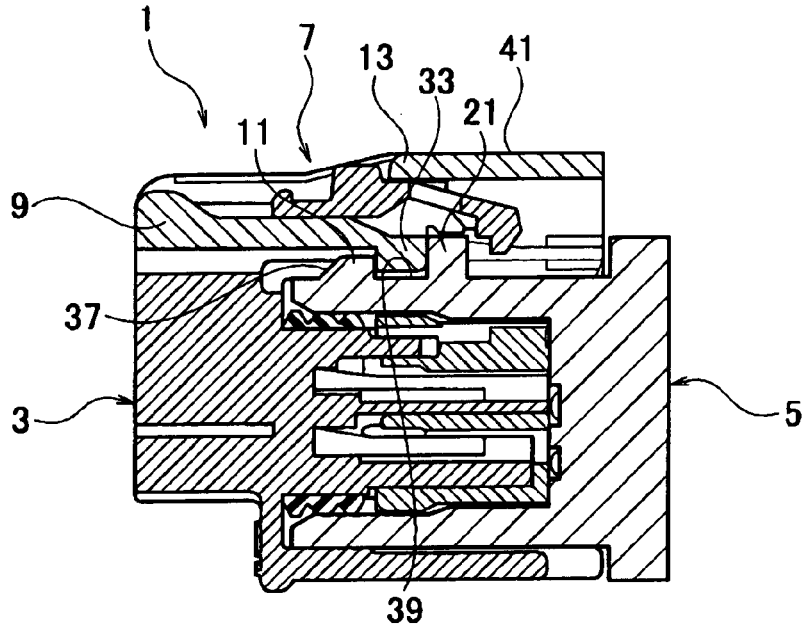
FIG. 8A is a cross-sectional view of the connector of the first embodiment, showing a condition in which the detection member is attached to the one housing.
Figure 8B:
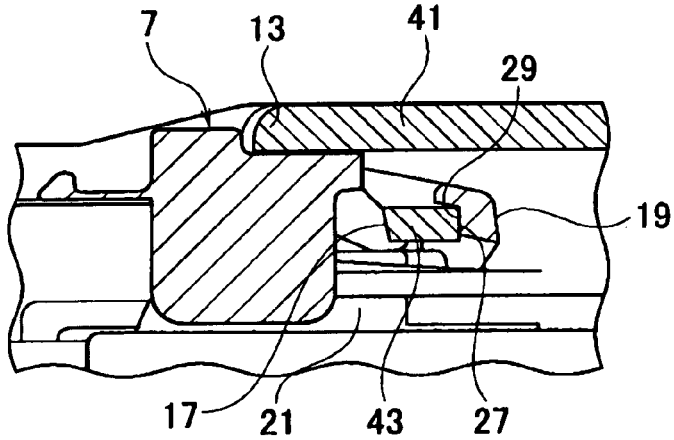
FIG. 8B is an enlarged cross-sectional view of an important portion of FIG. 8A.
Figure 8C:
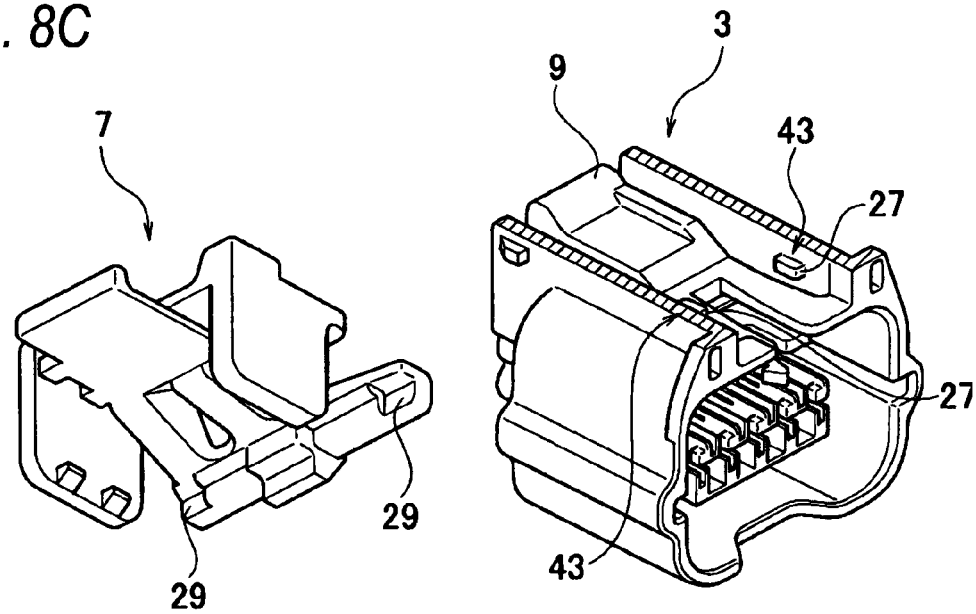
FIG. 8C is a perspective view of the connector of the first embodiment, showing a condition in which the detection member is detached, and the hood portion of the one housing is removed.
Figure 9:
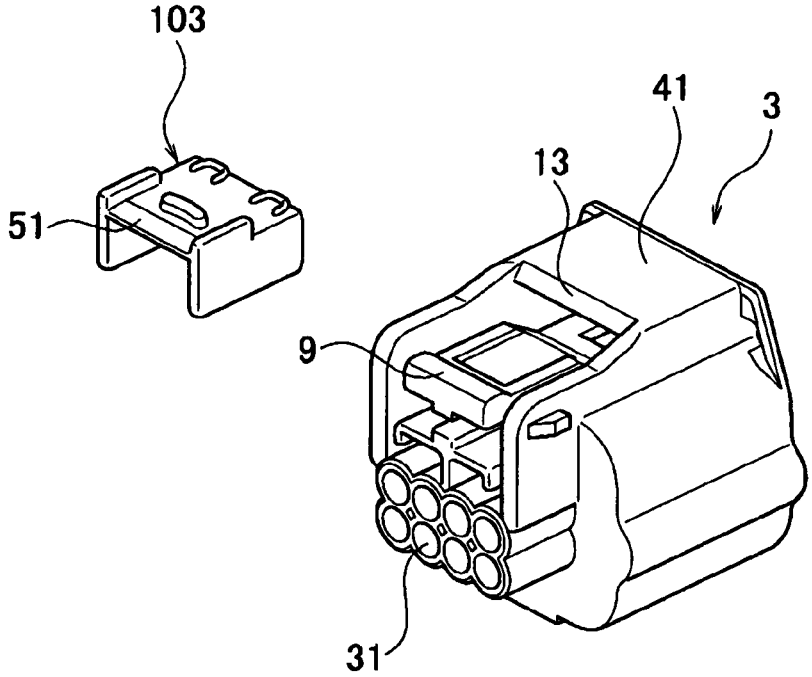
FIG. 9 is a perspective view showing one housing and a detection member of a second embodiment of a connector of the invention.
Figure 10:
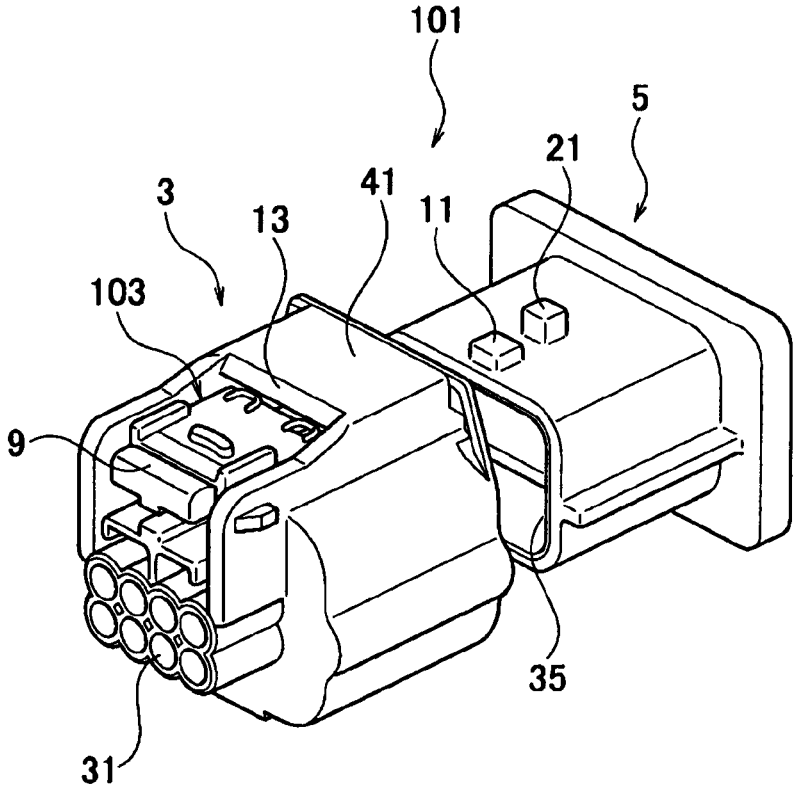
FIG. 10 is a perspective view of the connector of the second embodiment.
Figure 11A:
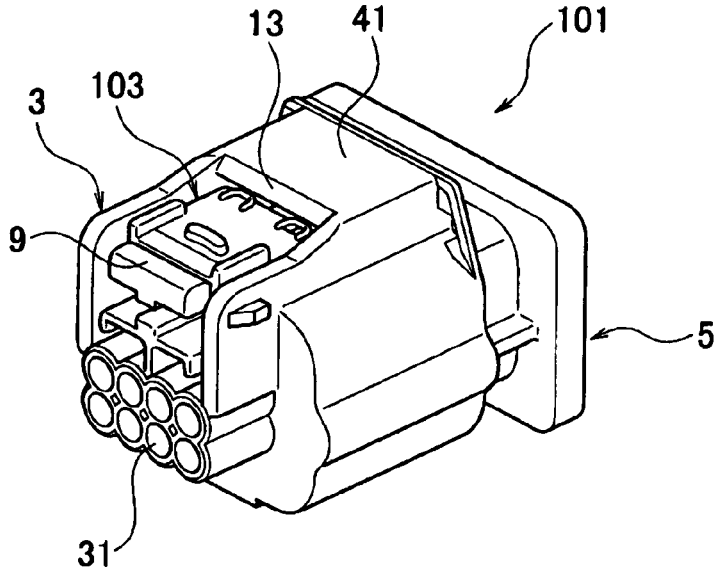
FIG. 11A is a perspective view of the connector of the second embodiment, showing a condition in which a pair of housings are to be fitted together.
Figure 11B:
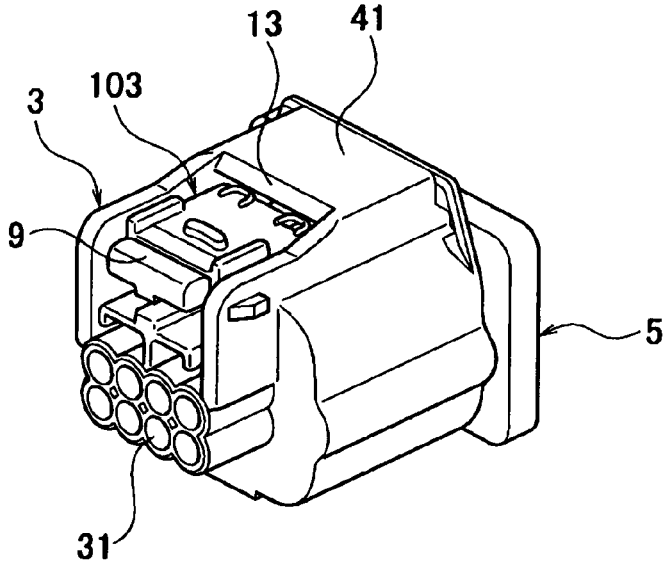
FIG. 11B is a perspective view showing a condition in which the pair of housings of FIG. 11A are fitted together.
Figure 11C:
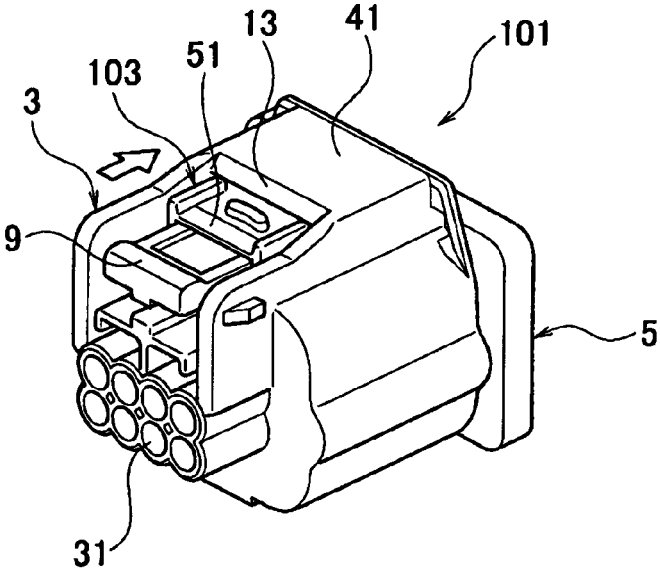
FIG. 11C is a perspective view showing a condition in which the detection member is attached to the one housing of FIG. 11B.
Figure 12A:
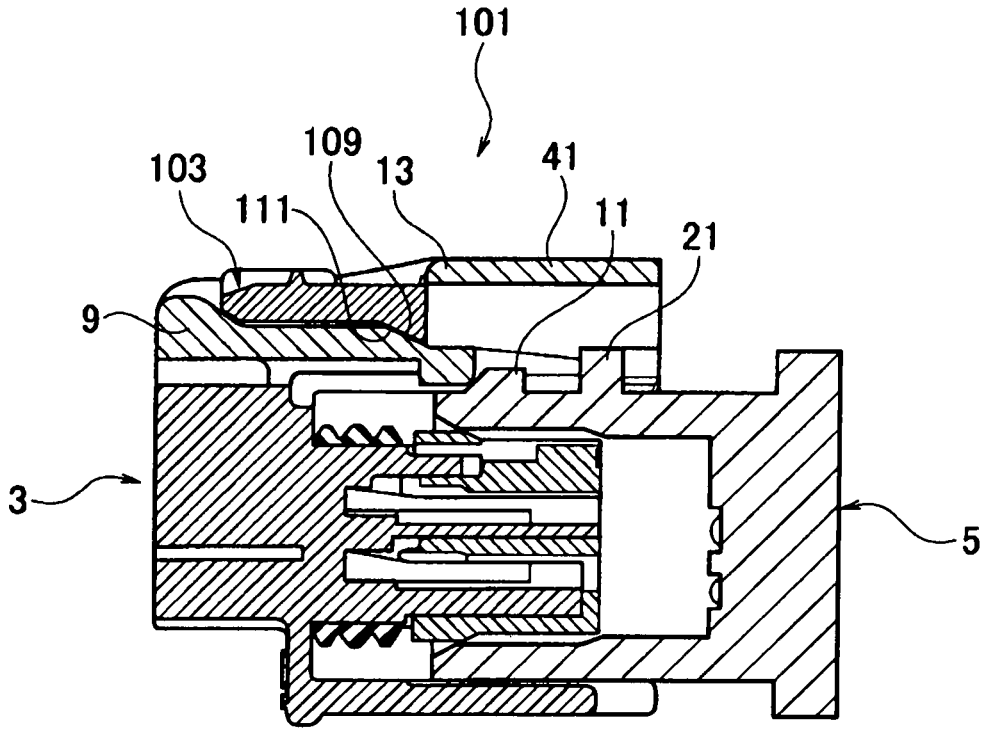
FIG. 12A is a cross-sectional view of the connector of the second embodiment, showing a condition before the pair of housings is fitted together.
Figure 12B:
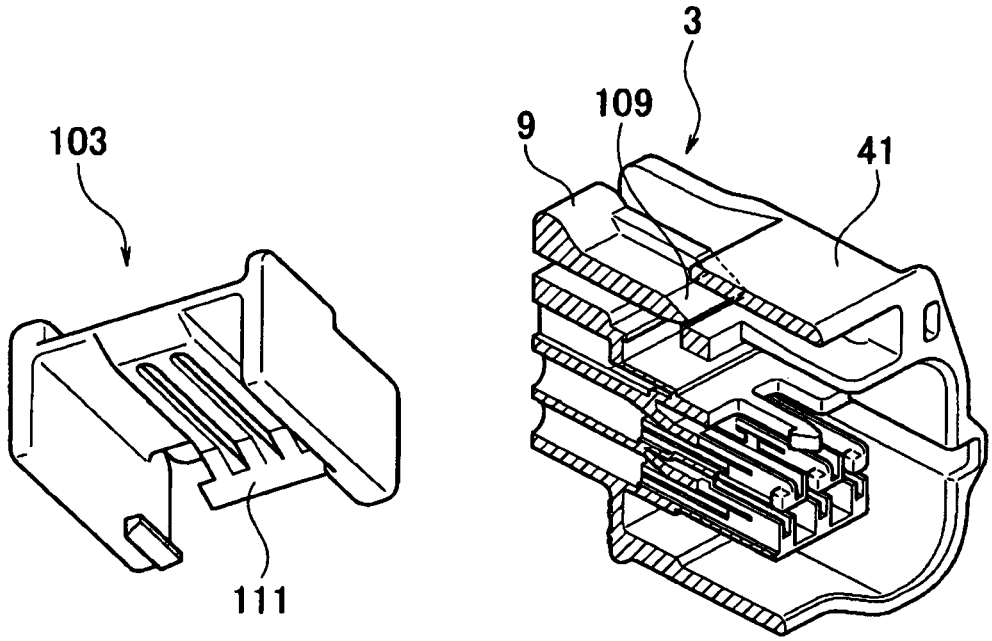
FIG. 12B is a partly cross-sectional view showing important portions of FIG. 12A.
Figure 13A:
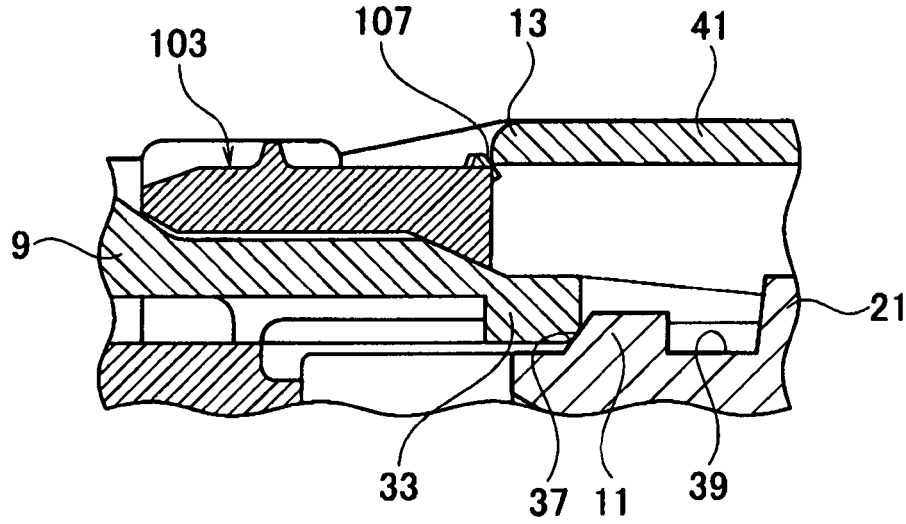
FIG. 13A is an enlarged cross-sectional view of an important portion of FIG. 12A.
Figure 13B:
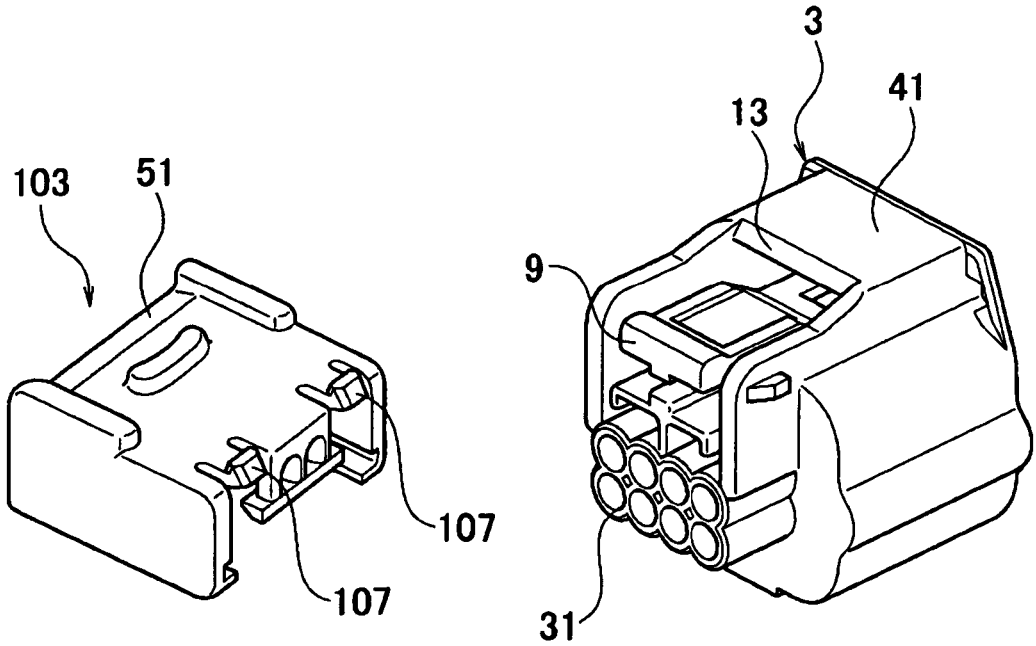
Figure 14A:
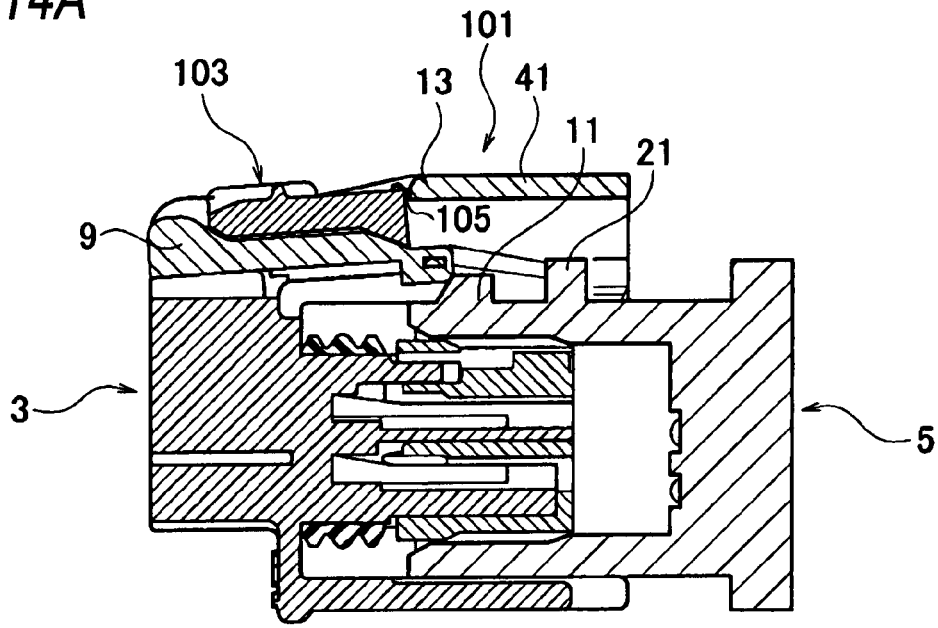
FIG. 14A is a cross-sectional view showing the connector of the second embodiment during the fitting of the pair of housings.
Figure 14B:
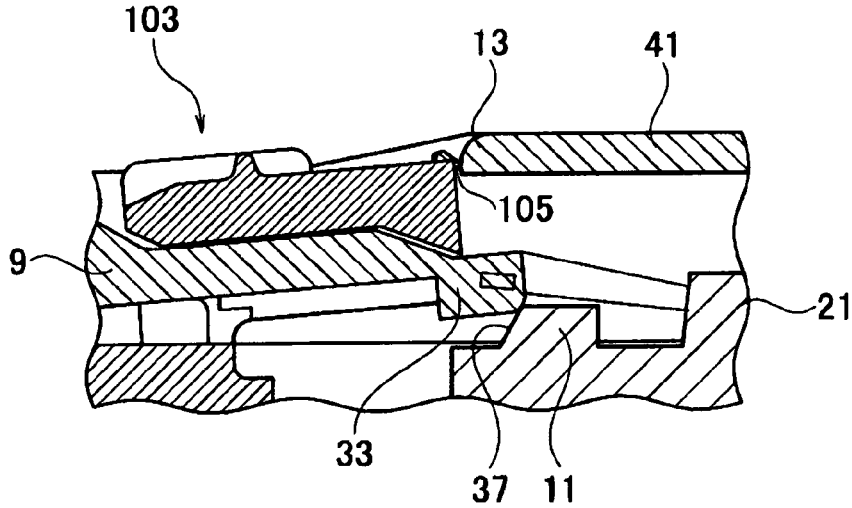
FIG. 14B is an enlarged cross-sectional view of an important portion of FIG. 14A.
Figure 14C:
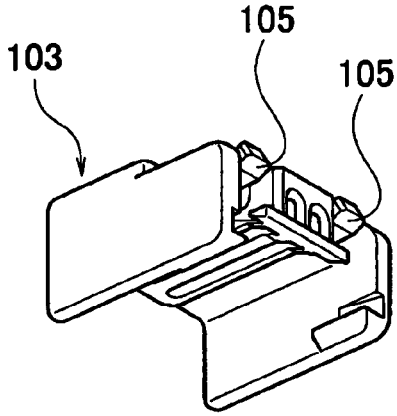
FIG. 14C is a perspective view of the detection member of the connector of the second embodiment.
Figure 15A:
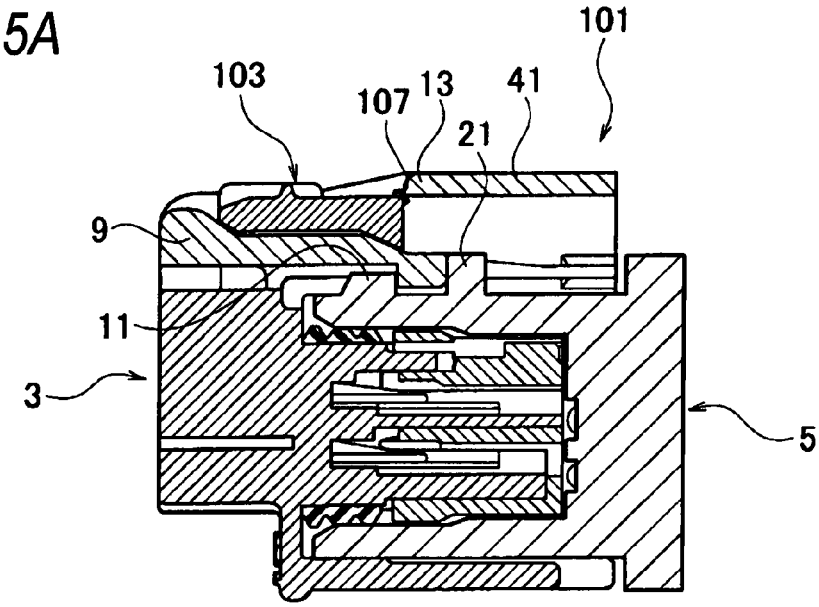
FIG. 15A is a cross-sectional view of the connector of the second embodiment, showing a condition in which the pair of housings are fitted together.
Figure 15B:
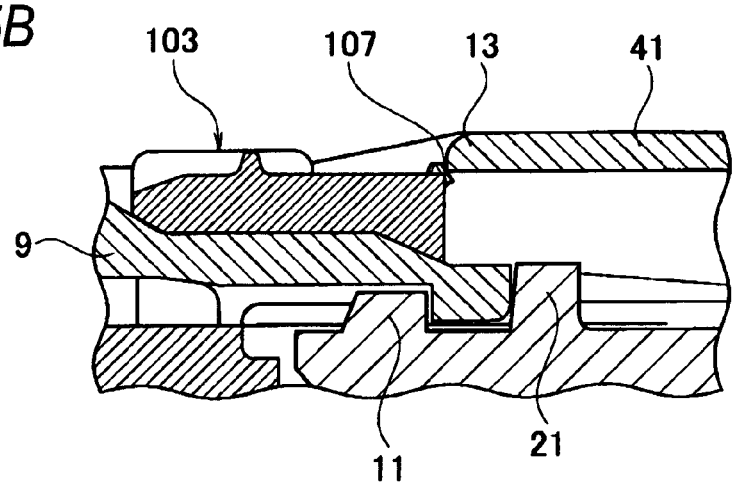
FIG. 15B is an enlarged cross-sectional view of an important portion of FIG. 15A.
Figure 15C:
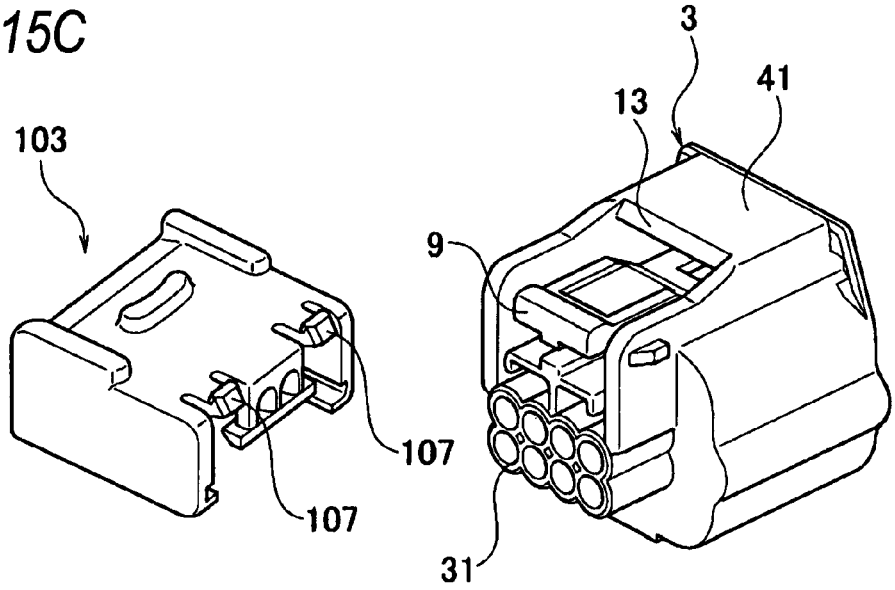
FIG. 15C is a perspective view showing the detection member and the one housing of the connector of the second embodiment.
Figure 16A:
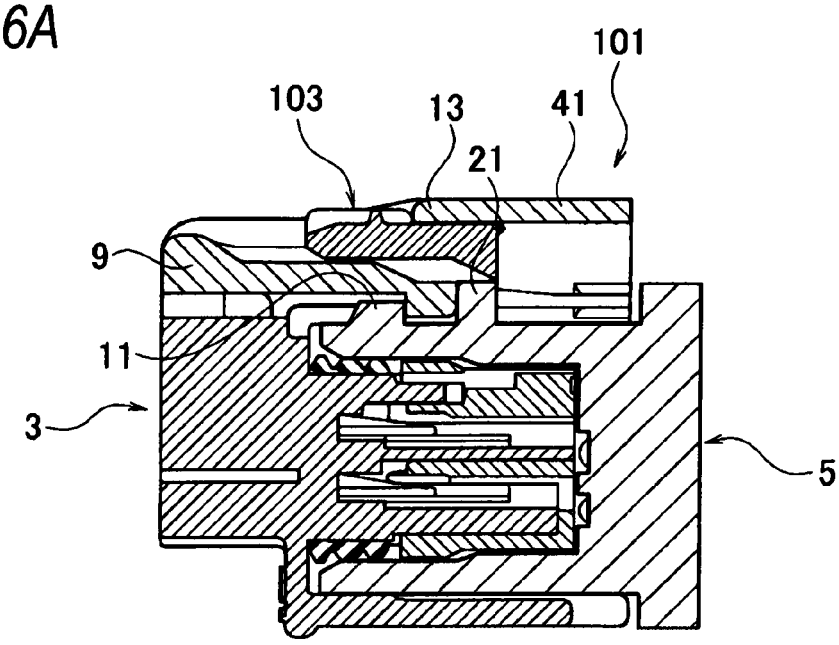
FIG. 16A is a cross-sectional view of the connector of the second embodiment, showing a condition in which the detection member is attached to the one housing.
Figure 16B:
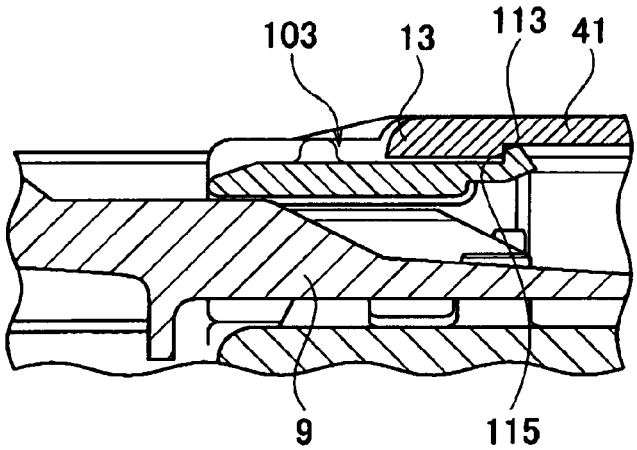
FIG. 16B is an enlarged cross-sectional view of an important portion of FIG. 16A.
Figure 16C:
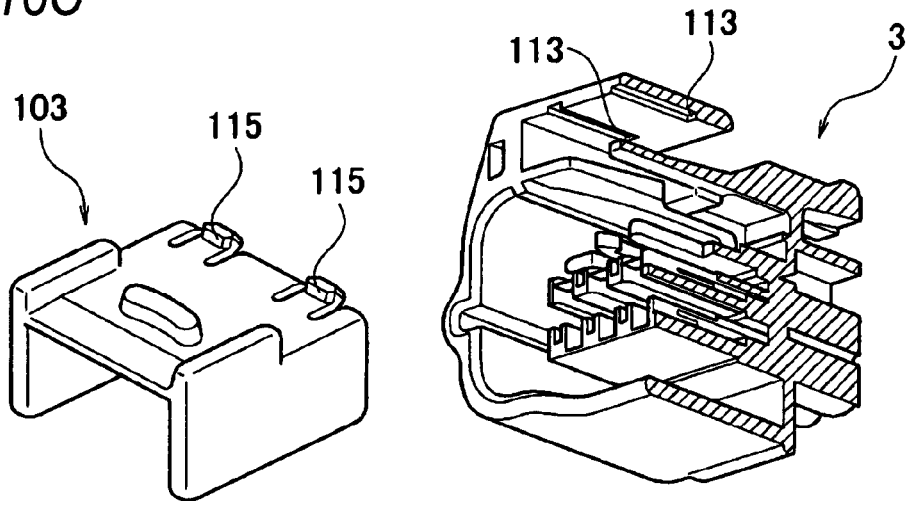
FIG. 16C is a perspective view of the detection member of the connector of the second embodiment and a cross-sectional view of the one housing, showing an important portion thereof.

Preferred embodiments of connectors of the present invention will be described with reference to FIGS. 1 to 16.

First Embodiment

A first embodiment of the invention will now be described with reference to FIGS. 1 to 8.

A connector 1 of this embodiment includes a pair of female and male housings 3 and 5 to be fitted together, and a detection member 7 attached to the female housing (first housing) 3 so as to detect a fitted condition of the pair of housings 3 and 5 through its movement in an attaching direction. A lock band portion 9 is elastically bendably (or deformably) formed on the female housing 3, and a lock portion 11 is provided on the male housing (the second housing) 5, and bends the lock band portion 9 to allow the lock band portion 9 to slide thereover when the pair of housings 3 and 5 are to be fitted together, and retains the lock band portion 9 when the pair of housings 3 and 5 are fitted together. The detection member 7 is disposed on an upper side of the lock band portion 9, and is displaced together with the lock band portion 9 in accordance with a bending movement of the lock band portion 9.

Movement limitation portions 15 are provided on the detection member 7, and abut against an abutment limitation portion 13 provided on the female housing 3 when the lock band portion 9 is disposed on the upper side of the lock portion 11, thereby preventing the detection member 7 from movement in the attaching direction. When the lock band portion 9 is retained by the lock portion 11, the abutting engagement of the movement limitation portions 15 with the abutment limitation portion 13 is canceled, so that the detection member 7 can be moved in the attaching direction.

A provisional movement limitation portion 19 is provided on the detection member 7, and abuts against provisional abutment limitation portions 17 provided on the female housing 3 before the fitting of the pair of housings 3 and 5, thereby preventing the movement of the detection member 7 in the attaching direction.

A provisional lock cancellation portion 21 is provided on the male housing 5, and holds the provisional abutment limitation portions 17 and the provisional movement limitation portion 19 in their abutment-canceled condition when the lock band portion 9 is retained by the lock portion 11.

A cancellation movement limitation portion 25 is provided on the detection member 7, and abuts against a cancellation abutment limitation portion 23 provided on the female housing 3 before the fitting of the pair of housings 3 and 5, thereby preventing the detection member 7 from movement in an attaching-cancellation direction.

Holding lock portions 29 are provided on the detection member 7, and are retained respectively by detection lock portions 27 provided on the female housing 3 when the detection member 7 is moved in the attaching direction after the fitting of the pair of housings 3 and 5, thereby holding the detection member 7 in an attached condition relative to the female housing 3.

As shown in FIGS. 1 to 8, the female housing 3 is formed into a generally tubular shape, and has a plurality of terminal receiving chambers 31 formed therein. Terminals (not shown) electrically connected to wires (not shown) or the like are received in the plurality of terminal receiving chambers 31, respectively. The lock band portion 9 is bendably provided on an upper portion of the female housing 3. A retaining projection 33 is formed on and projects downwardly from a distal end portion of the lock band portion 9. When the female housing 3 is fitted to the male housing 5, the retaining projection 33 of the lock band portion 9 is retainingly engaged with the lock portion 11 of the male housing 5, thereby holding the female and male housings 3 and 5 in the fitted condition.

The male housing 5 is formed into a generally tubular shape, and is smaller in peripheral size than the female housing 3, and has a plurality of terminal receiving chambers 35 formed therein. Mating terminals (not shown) electrically connected to wires (not shown) or the like are received respectively in the terminal receiving chambers 35, and are adapted to be electrically connected respectively to the terminals received in the female housing 3. The lock portion 11 is formed on and projects upwardly from an upper side of an outer peripheral surface of the male housing 5. A slanting surface 37 slanting in the direction of fitting of the male housing 5 to the female housing 3 is formed on the lock portion 11. The provisional lock cancellation portion 21 is formed rearwardly of the lock portion 11 in the fitting direction, and projects higher than the lock portion 11. A retaining recess 39 is formed between the lock portion 11 and the provisional lock cancellation portion 21. During the time when the male housing 5 is fitted to the female housing 3, the lock band portion 9 of the female housing 3 is bent upwardly by the slanting surface 37 of the lock portion 11, and then the retaining projection 33 of the lock band portion 9 slides over the lock portion 11, and is retainingly engaged in the retaining recess 39, so that the lock portion 11 and the lock band portion 9 are retained relative to each other.

A hood portion 41 is provided on the female housing 3 (which is one of the pair of housings 3 and 5 to be fitted together), and forms a space above the lock band portion 9. The detection member 7 for detecting the fitted condition of the pair of housings 3 and 5 through its movement in the attaching direction relative to the female housing 3 is mounted within the hood portion 41.

The detection member 7 is mounted within the hood portion 41 to be disposed on the upper side of the lock band portion 9, and is displaced together with the lock band portion 9 in accordance with the bending movement of the lock band portion 9. The detection member 7 includes the movement limitation portions 15, the provisional movement limitation portion 19, the cancellation movement limitation portion 25 and the holding lock portions 29.

The movement limitation portions 15 are provided on the detection member 7, and are disposed beneath the abutment limitation portion 13 of the female housing 3 when the detection member 7 is provisionally attached to the female housing 3 and hence is disposed on the upper side of the lock band portion 9. When the lock band portion 9 is disposed on the upper side of the lock portion 11, the detection member 7 is displaced upwardly, so that the movement limitation portions 15 are brought into abutting engagement with the abutment limitation portion 13. Because of this abutting engagement, the detection member 7 can not be moved toward the inner side of the hood portion 41 (in the attaching direction) when the lock band portion 9 and the lock portion 11 are not retained relative to each other, that is, when the pair of housings 3 and 5 are disposed in a half-fitted condition. When the lock band portion 9 and the lock portion 11 are retained relative to each other, the detection member 7 is displaced downwardly, so that the abutting engagement of the movement limitation portions 15 with the abutment limitation portion 13 is canceled. Because of this abutment cancellation, the detection member 7 can be moved toward the inner side of the hood portion 41 when the lock band portion 9 and the lock portion 11 are retained relative to each other, that is, when the pair of housings 3 and 5 is properly fitted together.

The provisional movement limitation portion 19 is defined by a distal end surface of a T-shaped portion (extending from a base portion of the detection member 7) facing in the attaching direction. When the detection member 7 is provisionally attached to the female housing 3, the provisional movement limitation portion 19 abuts against the provisional abutment limitation portions 17 defined respectively by those surfaces of side lock portions 43 (formed within the hood portion 41 of the female housing 3) which are opposed to the detection member 7. Because of this abutment, the detection member 7 is prevented from movement in the attaching direction when the detection member 7 is provisionally attached to the female housing 3. The abutment of the provisional movement limitation portion 19 with the provisional abutment limitation portions 17 is canceled when a lower surface 45 of that portion of the T-shaped portion of the detection member 7, at which the cancellation movement limitation portion 25 is formed, slides onto the upper surface of the provisional lock cancellation portion 21 of the male housing 5 in the retained condition of the lock band portion 9 and the lock portion 11. At this time, also, lower surfaces 47 of those portions of the T-shaped portion of the detection member 7, at which the provisional movement limitation portion 19 is formed, slide respectively onto upper surfaces 49 of the side lock portions 43, and this abutment-canceled condition is maintained. Therefore, when the pair of housings 3 and 5 is properly fitted together, the detection member 7 can move toward the inner side of the hood portion 41.

The cancellation limitation portion 25 is provided on a lower section of a central portion of the T-shaped portion. When the detection member 7 is provisionally attached to the female housing 3, the cancellation limitation portion 25 abuts against the cancellation abutment limitation portion 23 provided on a proximal end portion of the lock band portion 9 of the female housing 3. Because of this abutment, the detection member 7 is prevented from movement in the attaching-cancellation direction when the detection member 7 is provisionally attached to the female housing 3.

The holding lock portions 29 are defined respectively by those surfaces of the T-shaped portion facing away from the provisional movement limitation portion 19. When the detection member 7 is moved in the attaching direction after the fitting of the pair of housings 3 and 5, the holding lock portions 29 are retained respectively by the detection lock portions 27 defined respectively by those surfaces of the side lock portions 43 facing away from the provisional abutment limitation portions 17. Because of this retaining engagement, the detection member 7 is prevented from movement in the attaching-cancellation direction when the detection member 7 is completely attached to the female housing 3 (that is, when the detection member 7 is completely pushed into the inside of the hood portion 41), and the completely-attached condition of the detection member 7 is maintained.

The detection member 7 has an operating portion 51 against which the finger of the worker or other means can be held so as to push or move the detection member 7 in the attaching direction. For example, when the pair of housings 3 and 5 is disposed in a half-fitted condition, the movement limitation portions 15 are held against the abutment limitation portion 13, and therefore in this case, even when the operating portion 51 is pressed, the detection member 7 can not be moved in the attaching direction. On the other hand, when the pair of housings 3 and 5 is disposed in the properly-fitted condition, the abutment of the movement limitation portions 15 against the abutment limitation portion 13 is canceled, and therefore in this case, the detection member 7 can be moved in the attaching direction by pressing the operating portion 51. By thus providing the operating portion 51 at the detection member 7, the detection member 7 can be easily pushed to be moved in the attaching direction in the properly-fitted condition of the pair of housings 3 and 5.

The fitting operation of the pair of housings 3 and 5 of the connector 1 of the above construction, as well as the detecting operation of the detection member 7, will be described below.

Before (or at an initial stage of) the fitting of the pair of housings 3 and 5, the movement of the detection member 7 in the attaching direction is prevented by the abutment of the provisional movement limitation portion 19 against the provisional abutment limitation portions 17, and also the movement of the detection member 7 in the attaching-cancellation direction is prevented by the abutment of the cancellation movement limitation portion 25 against the cancellation abutment limitation portion 23, and therefore the provisionally-attached condition of the detection member 7 relative to the female housing 3 is maintained. In this condition, the detection member 7 can be kept provisionally-attached to the female housing 3, and therefore the detection member 7 and the female housing 3 can be handled as a unit.

During the half-fitting of (or in a half-fitted condition of) the pair of housings 3 and 5, the lock band portion 9 is bent upwardly by the lock portion 11, and the detection member 7 disposed on the upper side of the lock band portion 9 is also moved or displaced upwardly. As a result of this upward movement of the detection member 7, the movement limitation portions 15 are brought into abutting engagement with the abutment limitation portion 13, thereby preventing the detection member 7 from moving into the inside of the hood portion 41. Therefore, when the lock band portion 9 is not retained by the lock portion 11, that is, when the pair of housings 3 and 5 are disposed in a half-fitted condition, the detection member 7 can not be moved into the inside of the hood portion 41, and from this, the fact that the pair of housings 3 and 5 have not yet been properly fitted together can be detected.

When the pair of housings 3 and 5 is properly fitted together, the lock band portion 9 is retained by the lock portion 11, and the pair of housings 3 and 5 is held in the fitted condition. In this condition, the lock band portion 9 is restored downward into its initial condition, and also the detection member 7 disposed on the upper side of the lock band portion 9 is displaced or moved downward. As a result of this downward movement of the detection member 7, the abutment of the movement limitation portions 15 against the abutment limitation portion 13 is canceled. At this time, also, the lower surface 45 of the T-shaped portion of the detection member 7 is disposed on the upper surface of the provisional lock cancellation portion 21, and the lower surfaces 47 of this T-shaped portion are disposed respectively on the upper surfaces 49 of the side lock portions 43, and the provisional movement limitation portion 19 and the provisional abutment limitation portions 17 are held in their abutment-canceled condition. Therefore, the limitation of the movement of the detection member 7 into the inside of the hood portion 41 (in the attaching direction) is canceled. Therefore, when the lock band portion 9 is retained by the lock portion 11, that is, when the pair of housings 3 and 5 are disposed in the properly-fitted condition, the detection member 7 can be moved into the inside of the hood portion 41, and the fact that the pair of housings 3 and 5 have been properly fitted together can be detected.

After the pair of housings 3 and 5 are properly fitted together, the detection member 7 is moved into the inside of the hood portion 41, and the holding lock portions 29 are caused to be retained respectively by the detection lock portions 27. In this condition, the detection member 7 is prevented from movement in the attaching-cancellation direction, and the completely-attached condition of the detection member 7 is maintained.

In this connector 1, the detection member 7 is disposed on the upper side of the lock band portion 9, and is displaced together with the lock band portion 9 in accordance with the bending movement of the lock band portion 9. When the lock band portion 9 is disposed on the upper side of the lock portion 11, the movement limitation portions 15 provided on the detection member 7 abut against the abutment limitation portion 13 provided on the female housing 3, thereby preventing the detection member 7 from movement in the attaching direction. When the lock band portion 9 is retained by the lock portion 11, the abutment of the movement limitation portions 15 against the abutment limitation portion 13 is canceled, thereby enabling the detection member 7 to move in the attaching direction.

Therefore, the detection member 7 will not be deformed by the bending of the lock band portion 9, and in accordance with the displacement of the detection member 7 itself, the movement limitation portions 15 are brought into and out of abutting engagement with the abutment limitation portion 13, and the limitation of the movement of the detection member 7 and the cancellation of this movement limitation are effected, and the fitted condition of the pair of housings 3 and 5 can be detected.

Therefore, the detection member 7, even when used a plurality of times, will not be deformed, and the durability of the detection member 7 can be enhanced. And besides, since the detection member 7 will not be deformed, it is not necessary to provide a space for allowing the deformation of the detection member 7, and the connector is prevented from increasing in size. Furthermore, the space for the operation of the detection member 7 can be secured without changing the outer peripheral sizes of the pair of housings 3 and 5, and therefore it is not necessary to apply a considerable design change to existing housings.

Furthermore, the detection member 7 has the provisional movement limitation portion 19 which abuts against the provisional abutment limitation portions 17 of the female housing 3 before the fitting of the pair of housings 3 and 5, thereby preventing the detection member 7 from movement in the attaching direction. Therefore, before the pair of housings 3 and 5 is fitted together, the detection member 7 will not be attached to the female housing 3, and the detection member 7 can be positively held in a predetermined position before the detection.

Furthermore, the male housing 5 has the provisional lock cancellation portion 21 which holds the provisional movement limitation portion 19 and the provisional abutment limitation portions 17 in their abutment-canceled condition when the lock band portion 9 is retained by the lock portion 11. Therefore, when the lock band portion 9 is retained by the lock portion 11, the detection member 7 can be moved in the attaching direction, and the properly-fitted condition of the pair of housings 3 and 5 can be positively detected by the detection member 7.

Furthermore, the detection member 7 has the cancellation movement limitation portion 25 which abuts against the cancellation abutment limitation portion 23 of the female housing 3 before the fitting of the pair of housings 3 and 5, thereby preventing the detection member 7 from movement in the attaching-cancellation direction. Therefore, before the pair of housings 3 and 5 is fitted together, the detection member 7 can be prevented from being disengaged from the female housing 3, and the detection member 7 provisionally attached to the female housing 3 can be conveyed together with the female housing 3.

Furthermore, the detection member 7 has the holding lock portions 29 which are retained respectively by the detection lock portions 27 of the female housing 3 to thereby maintain the attached condition of the detection member 7 relative to the female housing 3 when the detection member 7 is moved in the attaching direction after the fitting of the pair of housings 3 and 5. Therefore, after the pair of housings 3 and 5 are fitted together, the detection member 7 can be positively held on the female housing 3.

Second Embodiment

A second embodiment of the invention will be described with reference to FIGS. 9 to 16.

In a connector 101 of this embodiment, a detection member 103 has movement limitation portions 105 which abut against an abutment limitation portion 13 of a female housing 3 to thereby prevent the detection member 103 from movement in an attaching direction when a lock band portion 9 is disposed on the upper side of a lock portion 11. When the lock band portion 9 is retained by a lock portion 11, the abutment of the movement limitation portions 105 against the abutment limitation portion 13 is canceled, thereby enabling the detection member 103 to move in the attaching direction.

The detection member 103 further has provisional movement limitation portions 107 which abut against the abutment limitation portion 13 (serving as a provisional abutment limitation portion) of the female housing 3 before the fitting of the pair of housings 3 and 5, thereby preventing the detection member 103 from movement in the attaching direction.

The detection member 103 further has a cancellation movement limitation portion 111 which abuts against a cancellation abutment limitation portion 109 of the female housing 3 before the fitting of the pair of housings 3 and 5, thereby preventing the detection member 103 from movement in an attaching-cancellation direction.

The detection member 103 further has holding lock portions 115 which are retained respectively by detection lock portions 113 of the female housing 3 to thereby hold the detection member 103 in an attached condition relative to the female housing 3 when the detection member 103 is moved in the attaching direction after the pair of housings 3 and 5 are fitted together. In this embodiment, those portions identical in construction to the corresponding portions of the first embodiment will be designated by identical reference numerals, respectively, and explanation of the constructions and functions thereof will be omitted. These portions achieve the same advantages as described for the first embodiment.

As shown in FIGS. 9 to 16, the detection member 103 is disposed on the upper side of the lock band portion 9, and is mounted within a hood portion 41. The detection member 103 is displaced together with the lock band portion 9 in accordance with a bending movement of the lock band portion 9. The detection member 103 includes the movement limitation portions 105, the provisional movement limitation portions 107, the cancellation movement limitation portion 111, and the holding lock portions 115.

A pair of claw-like portions is provided on a distal end of the detection member 103 facing in the attaching direction, and lower slanting surfaces of these claw-like portions define the movement limitation portions 105, respectively. These claw-like portions are disposed at the lower side of the abutment limitation portion 13 of the female housing 3 when the detection member 13 is provisionally attached to the female housing 3 and hence is disposed on the upper side of the lock band portion 9. When the lock band portion 9 is moved to be disposed on the upper side of the lock portion 11, so that the detection member 103 is moved or displaced upwardly, the movement limitation portions 105 are brought into abutting engagement with the abutment limitation portion 103. Because of this abutment, the detection member 103 can not be moved toward the inner side of the hood portion 41 when the lock band portion 9 is not retained by the lock portion 11, that is, when the pair of housings 3 and 5 is disposed in a half-fitted condition. When the lock band portion 9 is retained by the lock portion 11, so that the detection member 103 is displaced downwardly, the abutment of the movement limitation portions 105 against the abutment limitation portion 13 is canceled. Because of this abutment cancellation, the detection member 103 can be moved toward the inside of the hood portion 41 when the lock band portion 9 is retained by the lock portion 11, that is, when the pair of housings 3 and 5 is properly fitted together.

The provisional movement limitation portions 107 are defined respectively by slanting upper surfaces of the claw-like portions of the detection member 103. When the detection member 103 is provisionally attached to the female housing 3, the provisional movement limitation portions 107 abut against the abutment limitation portion 13. Slanting surfaces similar to the provisional movement limitation portions 107 may be formed on the abutment limitation portion 13 so as to be used as provisional movement limitation portions. Because of this abutment, the detection member 103 provisionally attached to the female housing 3 is prevented from being moved in the attaching direction by an accidental external force or the like. The inclination of the provisional movement limitation portions 107 is so determined that the abutment of the provisional movement limitation portions 17 against the abutment limitation portion 13 can be canceled by a force generally equal to a force by which the lock band portion 9 is brought into contact with the upper side of the lock portion 11. This abutment is canceled when the lock portion 9 is moved to be disposed on the upper side of the lock portion 11 or by pushing the detection member 103 into the inside of the hood portion 41. Therefore, this abutment will not prevent the movement limitation portions 105 from abutting against the abutment limitation portion 13, and also when the pair of housings 3 and 5 is disposed in the properly-fitted condition, the detection member 103 can be moved toward the inner side of the hood portion 41.

The cancellation movement limitation portion 111 is defined by a slanting surface provided on the lower side of the detection member 103. When the detection member 103 is provisionally attached to the female housing 3, the cancellation movement limitation portion 111 abuts against the cancellation abutment limitation portion 109 which is provided on the female housing 3 and is a slanting surface similar to the cancellation movement limitation portion 111. Because of this abutment, the detection member 103 provisionally attached to the female housing 3 is prevented from being moved in an attaching-cancellation direction by an accidental external force or the like.

The holding lock portions 115 are defined respectively by those surfaces of the claw-like portions of the detection member 103 facing away respectively from the provisional movement limitation portions 107. When the detection member 103 is moved in the attaching direction after the pair of housings 3 and 5 is fitted together, the holding lock portions 115 are retained respectively by the detection lock portions 113 formed in a projecting manner within the hood portion 41. Because of this retaining engagement, the detection member 103 completely attached to the female housing 3 is prevented from being moved in the attaching-cancellation direction, and the completely-attached condition of the detection member 103 is maintained.

The fitting operation of the pair of housings 3 and 5 of the connector 101 of the above construction, as well as the detecting operation of the detection member 103, will be described below.

Before (or at an initial stage of) the fitting of the pair of housings 3 and 5, the movement of the detection member 103 in the attaching direction is prevented by the abutment of the provisional movement limitation portions 107 against the provisional abutment limitation portion 13, and also the movement of the detection member 103 in the attaching-cancellation direction is prevented by the abutment of the cancellation movement limitation portion 111 against the cancellation abutment limitation portion 109, and therefore the provisionally-attached condition of the detection member 103 relative to the female housing 3 is maintained. In this condition, the abutment will not be canceled by an accidental external force other than an external force intentionally applied for the purpose of canceling the abutment, and the detection member 103 can be kept provisionally-attached to the female housing 3, and therefore the detection member 103 and the female housing 3 can be handled as a unit.

During the half-fitting of (or in a half-fitted condition of) the pair of housings 3 and 5, the lock band portion 9 is bent upwardly by the lock portion 11, and the detection member 103 disposed on the upper side of the lock band portion 9 is also moved or displaced upwardly. As a result of this upward movement of the detection member 103, the abutment of the provisional movement limitation portions 107 against the abutment limitation portion 13 is canceled, and the movement limitation portions 105 are brought into abutting engagement with the abutment limitation portion 13, thereby preventing the detection member 103 from moving into the inside of the hood portion 41 (in the attaching direction). Therefore, when the lock band portion 9 is not retained by the lock portion 11, that is, when the pair of housings 3 and 5 are disposed in a half-fitted condition, the detection member 103 can be moved into the inside of the hood portion 41, and from this, the fact that the pair of housings 3 and 5 have not yet been properly fitted together can be detected.

When the pair of housings 3 and 5 is properly fitted together, the lock band portion 9 is retained by the lock portion 11, and the pair of housings 3 and 5 is held in the fitted condition. In this condition, the lock band portion 9 is restored downward into its initial condition, and also the detection member 103 disposed on the upper side of the lock band portion 9 is displaced or moved downward. As a result of this downward movement of the detection member 103, the abutment of the movement limitation portions 105 against the abutment limitation portion 13 is canceled. Here, the movement limitation portions 105 are defined respectively by the slanting surfaces, and therefore can be brought out of abutting engagement with the abutment limitation portion 13 by the downward restoring movement of the lock band portion 9 (hence by the downward displacement of the detection member 103). Therefore, when the lock band portion 9 is retained by the lock portion 11, that is, when the pair of housings 3 and 5 are disposed in the properly-fitted condition, the detection member 103 can be pushed to be moved into the inside of the hood portion 41, and the fact that the pair of housings 3 and 5 have been properly fitted together can be detected.

After the pair of housings 3 and 5 are properly fitted together, the detection member 103 is pushed to be moved into the inside of the hood portion 41, and the holding lock portions 115 are caused to be retained respectively by the detection lock portions 113. In this condition, the detection member 103 is prevented from movement in the attaching-cancellation direction, and the completely-attached condition of the detection member 103 is maintained.

In this connector 101, the detection member 103 is disposed on the upper side of the lock band portion 9, and is displaced together with the lock band portion 9 in accordance with the bending movement of the lock band portion 9. When the lock band portion 9 is disposed on the upper side of the lock portion 11, the movement limitation portions 105 provided on the detection member 103 abut against the abutment limitation portion 13 provided on the female housing 3, thereby preventing the detection member 103 from movement in the attaching direction. When the lock band portion 9 is retained by the lock portion 11, the abutment of the movement limitation portions 105 against the abutment limitation portion 13 is canceled, thereby enabling the detection member 103 to move in the attaching direction.

Therefore, the detection member 103 will not be deformed by the bending of the lock band portion 9, and in accordance with the displacement of the detection member 103 itself, the movement limitation portions 105 are brought into and out of abutting engagement with the abutment limitation portion 13, and the limitation of the movement of the detection member 103 and the cancellation of this movement limitation are effected, and the fitted condition of the pair of housings 3 and 5 can be detected.

Therefore, the detection member 103, even when used a plurality of times, will not be deformed, and the durability of the detection member 103 can be enhanced. And besides, since the detection member 103 will not be deformed, it is not necessary to provide a space for allowing the deformation of the detection member 103, and the connector is prevented from increasing in size. Furthermore, the space for the operation of the detection member 103 can be secured without changing the outer peripheral sizes of the pair of housings 3 and 5, and therefore it is not necessary to apply a considerable design change to existing housings.

Furthermore, the detection member 103 has the provisional movement limitation portions 107 which abut against the abutment limitation portion 13 of the female housing 3 before the fitting of the pair of housings 3 and 5, thereby preventing the detection member 103 from movement in the attaching direction. Therefore, before the pair of housings 3 and 5 is fitted together, the detection member 103 will not be attached to the female housing 3, and the detection member 103 can be positively held in a predetermined position before the detection.

Furthermore, the detection member 103 has the cancellation movement limitation portion 111 which abuts against the cancellation abutment limitation portion 109 of the female housing 3 before the fitting of the pair of housings 3 and 5, thereby preventing the detection member 103 from movement in the attaching-cancellation direction. Therefore, before the pair of housings 3 and 5 is fitted together, the detection member 103 can be prevented from being disengaged from the female housing 3, and the detection member 103 provisionally attached to the female housing 3 can be conveyed together with the female housing 3.

Furthermore, the detection member 103 has the holding lock portions 115 which are retained respectively by the detection lock portions 113 of the female housing 3 when the detection member 103 is moved in the attaching direction after the fitting of the pair of housings 3 and 5. Therefore, after the pair of housings 3 and 5 are fitted together, the detection member 103 can be positively held on the female housing 3.

Third Embodiment

Figure 17A:
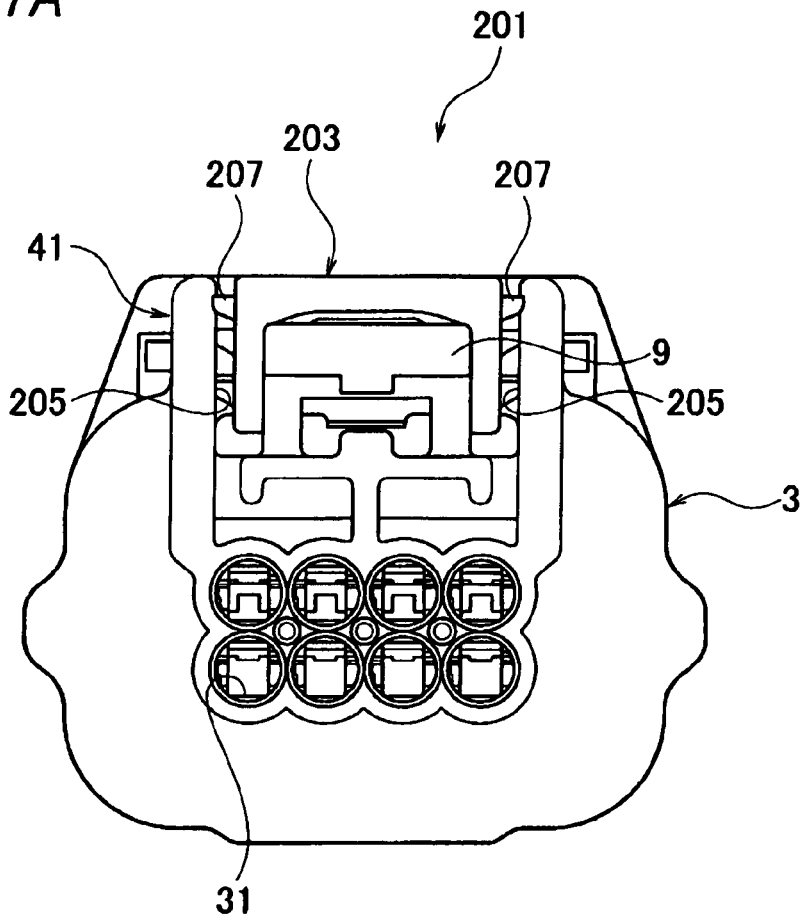
FIG. 17A is a side-elevational view of a third embodiment of a connector of the invention.
Figure 17B:
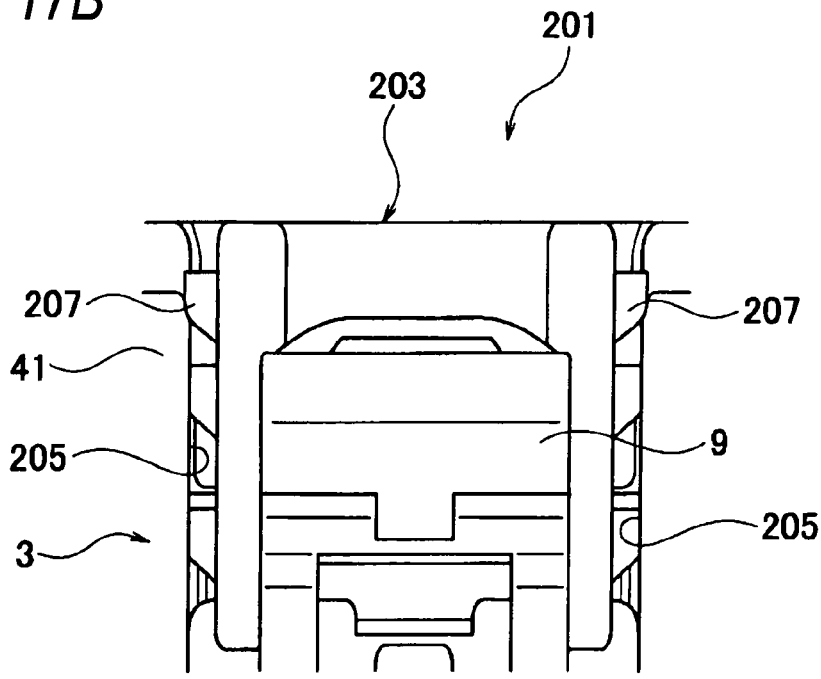
FIG. 17B is an enlarged view of an important portion of FIG. 17A.
Figure 18A:
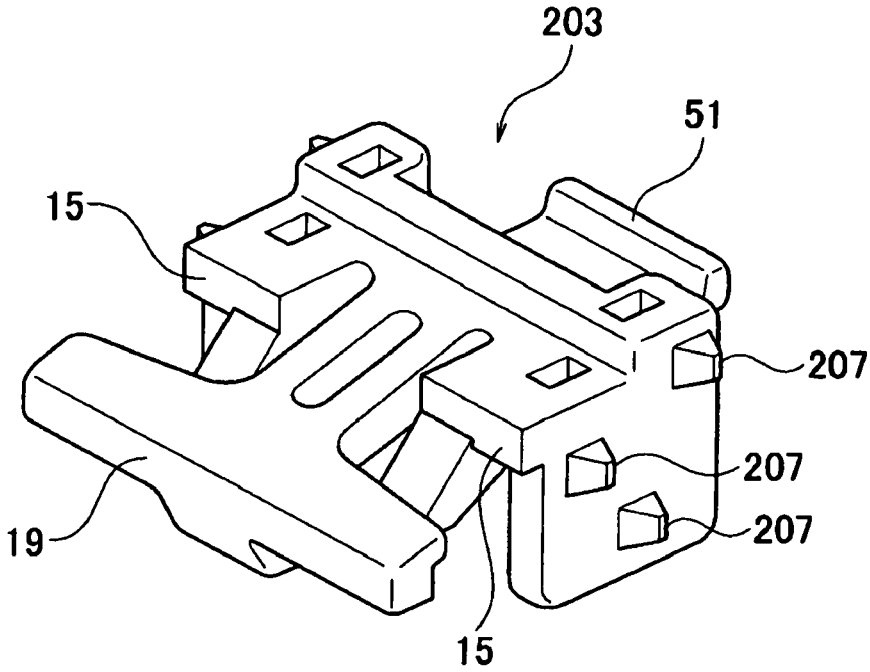
FIG. 18A is a perspective view of a detection member of the connector of the third embodiment.
Figure 18B:
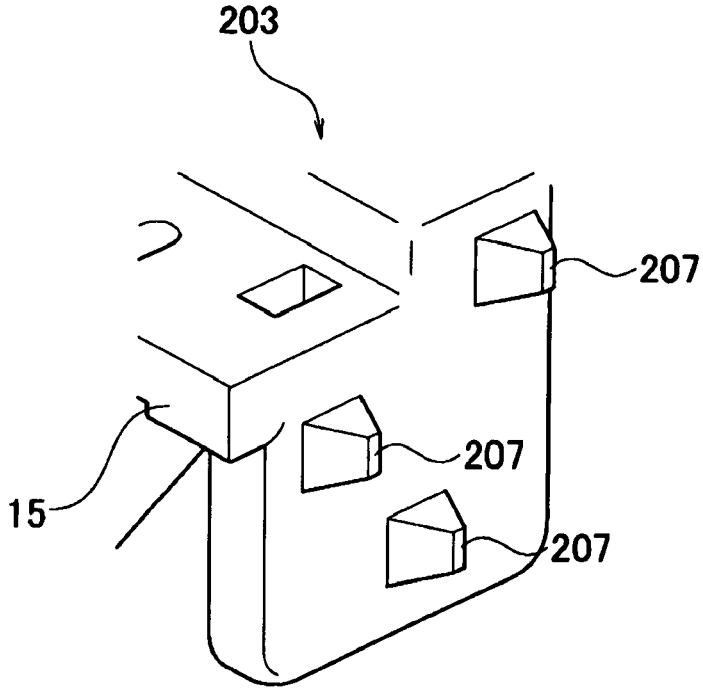
FIG. 18B is an enlarged view of an important portion of FIG. 18A.
Figure 19:
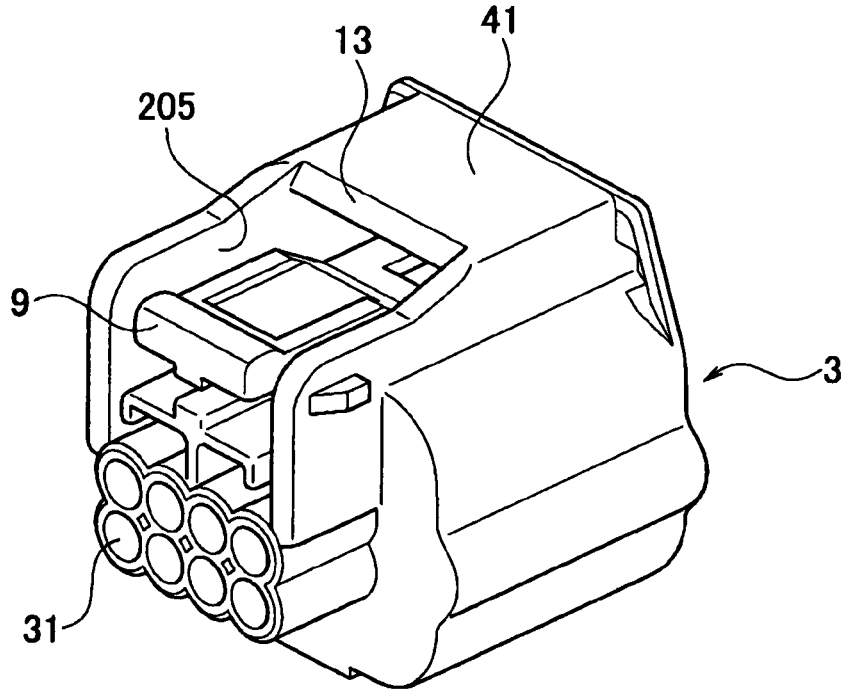
FIG. 19 is a perspective view of one housing of the connector of the third embodiment.
Figure 20:
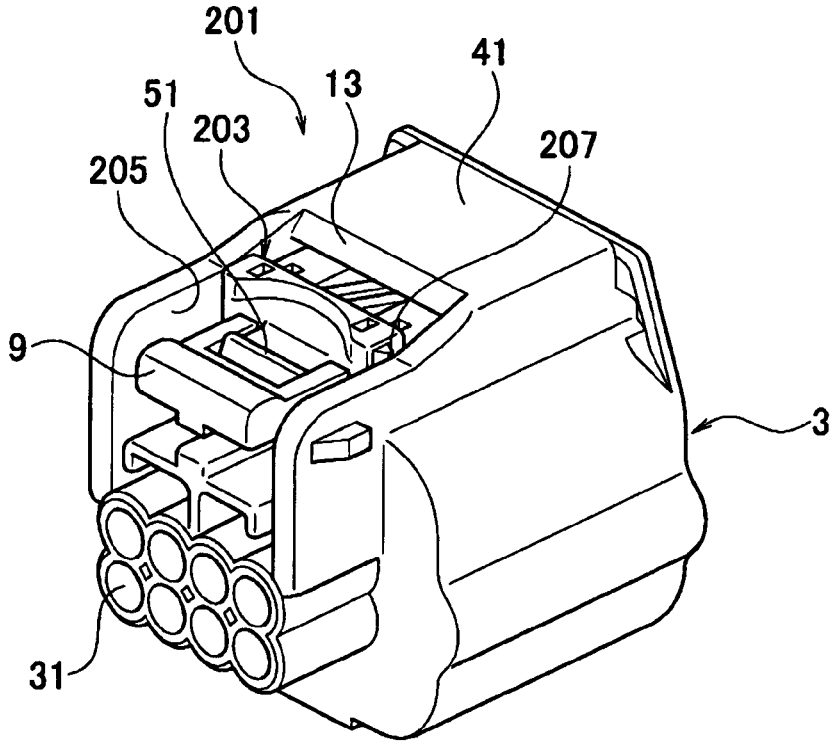
FIG. 20 is a perspective view of the connector of the third embodiment, showing a condition in which the detection member is attached to the one housing.

Next, a third embodiment of the invention will be described with reference to FIGS. 17 to 20.

In a connector 201 of this embodiment, a detection member 203 has shaking limitation portions 207 which abut against shaking abutment limitation portions 205 provided on a female housing 3 before the fitting of a pair of housings 3 and 5, thereby limiting or preventing the movement of the detection member 203 in a direction intersecting an attaching direction. In this embodiment, those portions identical in construction to the corresponding portions of the first embodiment will be designated by identical reference numerals, respectively, and explanation of the constructions and functions thereof will be omitted. These portions achieve the same advantages as described for the first embodiment.

As shown in FIGS. 17 to 20, the shaking limitation portions 207 are defined respectively by distal end surfaces of a plurality of projections formed on opposite side faces of the detection member 203 (In the illustrated embodiment, three projections are formed on each of the opposite side faces of the detection member 203.). When the detection member 203 is provisionally attached to the female housing 3, the shaking limitation portions 207 abut against the shaking abutment limitation portions 205 defined respectively by opposed inner side surfaces of a hood portion 41 of the female housing 3. Because of this abutment, the detection member 203, when provisionally attached to the female housing 3, is prevented from moving in the direction intersecting the attaching direction, that is, from shaking relative to the female housing 3, and the provisionally-attached condition of the detection member 203 can be maintained in a stable manner.

Although the plurality of shaking limitation portions 207 are provided at each of the opposite side faces of the detection member 203, only one shaking limitation portion 207 may be provided at each side face if the shaking of the detection member 203 can be limited, or a larger number of shaking limitation portions may be provided at each side face if the shaking of the detection member 203 can be limited more positively. In the connector 201 of this embodiment, although the detection member 203 is similar in shape to the detection member 3 of the first embodiment, the shaking limitation portions 207 can be provided at the detection member 103 of the second embodiment. Furthermore, the shaking limitation portions 207, as well as the shaking abutment limitation portions 205, may have any suitable shape in so far as the shaking of the detection member 203 relative to the female housing 3 can be limited.

In the connector 201 of this embodiment, the detection member 203 has the shaking limitation portions 207 which abut against the shaking abutment limitation portions 205 of the female housing 3 before the fitting of the pair of housings 3 and 5, thereby limiting or preventing the movement of the detection member 203 in the direction intersecting the attaching direction. Therefore, the detection member 203 will not shake relative to the female housing 3 before the fitting of the pair of housings 3 and 5, and the detection member 203 can be stably held in the provisionally-attached condition relative to the female housing 3.

In the connectors of the above embodiments, although two kinds of detection members of different shapes are used, the detection members may have any suitable shape in so far as the detection member itself can be displaced, and will not be deformed in such a manner that the various portions thereof including the movement limitation portions affect the functions of the neighboring members disposed adjacent to the detection member.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2009-162470 filed on Jul. 9, 2009, the contents of which are incorporated herein by reference.

What is claimed is:

1. A connector comprising:

a first housing, which includes a hood portion:

a second housing that is fitted to the first housing: and a detection member that is attached to the first housing to detect a fitted condition of the first and second housings by a state of a movement-limitation of the detection member in an attaching direction of the first housing to the second housing, wherein a lock band portion is elastically deformable and is provided on the first housing within the hood portion;

wherein a lock portion is provided on the second housing, and bends the lock band portion to allow the lock band portion to slide over the lock portion when the first and second housings are moved from a first condition to a second condition, and engages the lock band portion when the first and second housings has been moved to the second position, the first condition where the first housing is not fitted to the second housing and the second condition where the first housing is fitted to the second housing;

wherein the detection member is disposed on an upper side of the lock band portion within the hood portion, and is displaced together with the lock band portion in accordance with a deforming movement of the lock band portion;

wherein a movement limitation portion is provided on the detection member, and abuts against an abutment limitation portion provided on the hood portion of the first housing while the first and second housings are moved from the first condition to the second condition, so that the detection member is prevented from movement in the attaching direction; and wherein when the lock portion engages the lock band portion in the second condition, an abutment of the movement limitation portion against the abutment limitation portion is canceled, so that the detection member is allowed to be moved in the attaching direction.

2. The connector according to claim 1, wherein the detection member has a shaking limitation portion which abuts against a shaking abutment limitation portion provided on the first housing before the second condition to limit the movement of the detection member in a direction intersecting the attaching direction.

3. The connector according to claim 1, wherein the detection member has a provisional movement limitation portion which abuts against a provisional abutment limitation portion provided on the first housing before the second condition to limit the movement of the detection member in the attaching direction.

4. The connector according to claim 3, wherein the second housing has a provisional lock cancellation portion which holds a state in which an abutment of the provisional abutment limitation portion and the provisional movement limitation portion is cancelled when the lock portion engages the lock band portion.

5. The connector according to claim 1, wherein the detection member has a cancellation movement limitation portion which abuts against a cancellation abutment limitation portion provided on the first housing before the second condition, so that the detection member is prevented from movement in a cancellation direction opposite to the attaching direction.

6. The connector according to claim 1, wherein the detection member has a holding lock portion which is retained by a detection lock portion provided on the first housing to maintain an attached condition of the detection member relative to the first housing when the detection member is moved in the attaching direction in the second condition.

7. A connector comprising:

a first housing;

a second housing that is fitted to the first housing: and a detection member that is attached to the first housing to detect a fitted condition of the first and second housings by a movement of the detection member in an attaching direction of the detection member to the first housing, wherein a lock band portion is elastically deformable and is provided on the first housing;

wherein a lock portion is provided on the second housing, and bends the lock band portion to allow the lock band portion to slide over the lock portion when the first and second housings are moved from a first condition to a second condition, and engages the lock band portion when the first and second housings have been moved to the second position, the first condition where the first housing is not fitted to the second housing and the second condition where the first housing is fitted to the second housing;

wherein the detection member is disposed on an upper side of the lock band portion, and is displaced together with the lock band portion in accordance with a deforming movement of the lock band portion;

wherein a movement limitation portion is provided on the detection member, and abuts against an abutment limitation portion provided on the first housing while the first and second housings are moved from the first condition to the second condition, so that the detection member is prevented from movement in the attaching direction;

wherein when the lock portion engages the lock band portion in the second condition, an abutment of the movement limitation portion against the abutment limitation portion is canceled, so that the detection member is allowed to be moved in the attaching direction; and wherein the detection member has a cancellation movement limitation portion which abuts against a cancellation abutment limitation portion provided on the first housing before the second condition, so that the detection member is prevented from movement in a cancellation direction opposite to the attaching direction.

* * * * *